US005166046A

United States Patent [19]

Okusa et al.

[11] Patent Number: 5,166,046

[45] Date of Patent: Nov. 24, 1992

[54] SPECTRALLY SENSITIZED SILVER HALIDE PHOTOGRAPHIC MATERIAL

[75] Inventors: Hiroshi Okusa; Nobuaki Kagawa; Shinri Tanaka, all of Hino, Japan

[73] Assignee: Konica Corporation, Tokyo, Japan

[21] Appl. No.: 639,690

[22] Filed: Jan. 10, 1991

[30] Foreign Application Priority Data

Jan. 24, 1990 [JP] Japan ..... 2-14421

[51] Int. Cl.[5] ..... G03C 1/16; G03C 1/18; G03C 1/28

[52] U.S. Cl. ..... 430/572; 430/576; 430/583; 430/585; 430/588; 430/594; 430/567

[58] Field of Search ..... 430/567, 576, 583, 584, 430/585, 588, 594, 572

[56] References Cited

U.S. PATENT DOCUMENTS

| | | | |
|---|---|---|---|
| 2,313,922 | 3/1942 | Carroll et al. . | |
| 2,852,385 | 9/1958 | Jones | 430/576 |
| 3,847,621 | 11/1974 | Nishina et al. | 430/576 |
| 4,442,201 | 4/1984 | Takada et al. | 430/576 |
| 4,686,178 | 8/1987 | Honda et al. | 430/567 |
| 5,059,517 | 10/1991 | Ihama et al. | 430/567 |

FOREIGN PATENT DOCUMENTS 0349286 1/1990 European Pat. Off. .

OTHER PUBLICATIONS

M. Zahradnik: "The Production and Application of Fluorescent Brightening Agents" pp. 78–81, 1982, John Wiley & Sons, Cichester, GB * pp. 78–81 *.

*Primary Examiner*—Charles L. Bowers, Jr.
*Assistant Examiner*—Janet C. Baxter
*Attorney, Agent, or Firm*—Frishauf, Holtz, Goodman & Woodward

[57] ABSTRACT

The present invention relates to a silver halide photographic material having one or more light-sensitive silver halide emulsion layers on a support, which said photographic material is characterized in that at least one of said light-sensitive emulsion layers contains silver halide grains that are spectrally sensitized with at least one of the spectral sensitizers represented by the following general formula (I) and further contains at least one of the compounds represented by the following general formulas (II) and (III):

(I)

(II)

(III)

wherein the variables are as defined in the specification.

17 Claims, No Drawings

SPECTRALLY SENSITIZED SILVER HALIDE PHOTOGRAPHIC MATERIAL

BACKGROUND OF THE INVENTION

This invention relates to a spectrally sensitized silver halide photographic material, more particularly to a silver halide photographic material that is low in fog, that has enhanced spectral sensitivity and that can be stored for a prolonged time without deterioration after its preparation (i.e. has good raw stock stability).

As is well known, certain kinds of cyanine dyes and merocyanine dyes are very effective means of spectrally sensitizing silver halide emulsions. However, these dyes, if used alone, are incapable of providing sufficient sensitivity and they are usually combined with certain other spectral sensitizers or organic compounds to attain higher sensitivity by providing emulsions with sensitivity that is greater than the simple sum of the sensitivities achievable by the individual compounds. This effect is commonly known in the art as "supersensitization".

Generally speaking, the addition of a second dye or organic material will often either fail to increase the sensitivity or reduce it, so supersensitization may well be regarded as a peculiar phenomenon and the organic compound or second sensitizing dye to be combined must be selected with extremely close tolerance. Thus, a seemingly slight difference in chemical structure can cause marked effects on the supersensitizing action and it is difficult to obtain an appropriate combination for supersensitization merely by prediction from chemical structural formulas.

When spectral sensitizers are to be used to achieve supersensitization in silver halide photographic emulsions, they are required to provide high spectral sensitivity. It is well known that styryl bases exhibit a strong supersensitizing action in the spectral sensitization of silver halides with monomethine cyanine dyes. See, for example, T. H. James, "The Theory of the Photographic Process", Fourth Edition, p. 264, Macmillan Publishing Co., Inc., New York, 1977.

It is also known that styryl bases exhibit a strong supersensitizing action in the spectral sensitization of silver halides with various other cyanine dyes (see, for example, U.S. Pat. No. 2,313,922).

In both references mentioned above, the styryl bases used are those represented by the following general formula (IV) having an amino group on the benzene ring which is substituted by a substituted or unsubstituted alkyl group:

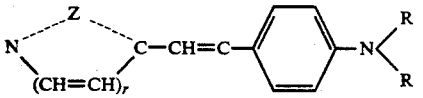

(IV)

where Z is the nonmetallic atomic group necessary to form a 5- or 6-membered hetero ring; r is 0 or 1; and R is a substituted or unsubstituted alkyl group). However, silver halide photographic emulsions supersensitized by these methods are still unsatisfactory in terms of spectral sensitivity; further, they are prone to suffer from increased fog and the raw stock stability of light-sensitive samples is also insufficient.

SUMMARY OF THE INVENTION

An object, therefore, of the present invention is to provide a silver halide photographic material that is low in fog, that has enhanced spectral sensitivity and that can be stored for a prolonged time without deterioration after its preparation.

The present inventors conducted intensive studies in order to develop a silver halide photographic material that satisfies their need and found that the above-stated object of the present invention can be attained by a silver halide photographic material having one or more light-sensitive silver halide emulsion layers on a support, which photographic material is characterized in that at least one of said light-sensitive emulsion layers contains silver halide grains that are spectrally sensitized with at least one of the spectral sensitizers represented by the following general formula (I) and further contains at least one of the compounds represented by the following general formulas (II) and (III):

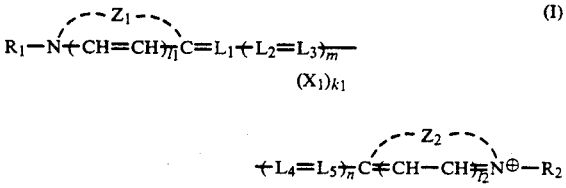

(I)

where $Z_1$ and $Z_2$ each represents the atomic group necessary to form a 5- or 6-membered nitrogenous hetero ring; $L_1$, $L_2$, $L_3$, $L_4$ and $L_5$ are each a methine group; $R_1$ and $R_2$ are each independently a substituted or unsubstituted alkyl group; $X_1$ is a charge balancing counter ion; $K_1$ represents a value of zero or more for neutralizing electric charges; $l_1$ and $l_2$ are each an integer of 0 or 1; and m and n are each an integer of 0–2;

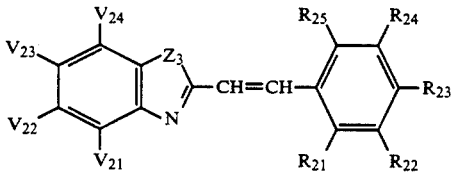

(II)

where $Z_3$ is an oxygen atom, a sulfur atom, a selenium atom, a tellurium atom or

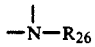

group; $V_{21}$, $V_{22}$, $V_{23}$ and $V_{24}$ are each a hydrogen atom, a halogen atom, an aryl group, an alkyl group, a substituted alkyl group, an alkoxyl group, an alkoxycarbonyl group, a carboxyl group, a hydroxyl group or a cyano group, provided that $V_{21}$ and $V_{22}$, or $V_{22}$ and $V_{23}$ or $V_{23}$ and $V_{24}$ may be condensed together to form a benzene ring; $R_{21}$, $R_{22}$, $R_{23}$, $R_{24}$ and $R_{25}$ are each a hydrogen atom, a halogen atom, a hydroxyl group, an alkyl group, an alkoxyl group, an aryl group or a group capable of forming a 5- or 6-membered ring through condensation of adjacent substituents; and $R_{26}$ is a substituted or unsubstituted alkyl or aryl group;

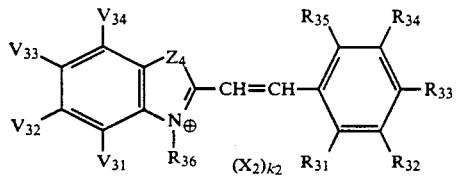

(III)

where $Z_4$ has the same meaning as $Z_3$; $V_{31}$, $V_{32}$, $V_{33}$ and $V_{34}$ have the same meanings as $V_{21}$, $V_{22}$, $V_{23}$ and $V_{24}$; $R_{31}$, $R_{32}$, $R_{33}$, $R_{34}$ and $R_{35}$ have the same meanings as $R_{21}$, $R_{22}$, $R_{23}$, $R_{24}$ and $R_{25}$; $X_2$ and $K_2$ have the same meanings as $X_1$ and $K_1$; and $R_{36}$ is substituted or unsubstituted alkyl or aryl group.

The objects of the present invention can be accomplished more effectively if the silver halide grains contained in at least one light-sensitive silver halide emulsion layer which are spectrally sensitized with at least one of the spectral sensitizers of the general formula (I) have a core/shell structure.

DETAILED DESCRIPTION OF THE INVENTION

The general formula (I) is described below in detail.

The nitrogenous hetero rings formed by $Z_1$ and $Z_2$ in the general formula (I) are 5- or 6-membered hetero rings commonly used in cyanine dyes, or those rings which are formed by condensing said 5- or 6-membered hetero rings with a benzene or naphthalene ring. Examples of the hetero rings formed by $Z_1$ and $Z_2$ are cyanine heterocyclic nuclei that are composed of a thiazole ring, a selenazole ring, an oxazole ring, a tetrazole ring, a pyridine ring, a pyrroline ring or an imidazole ring and which have substituents on the ring.

More specific examples include: thiazolic nuclei such as thiazole, 4-methylthiazole, 4-phenylthiazole, 5-methylthiazole, 5-phenylthiazole, 4,5-dimethylthiazole, 4,5-diphenylthiazole, benzothiazole, 5-fluorobenzothiazole, 5-chlorobenzothiazole, 6-chlorobenzothiazole, 5-methylbenzothiazole, 6-methylbenzothiazole, 5-bromobenzothiazole, 5-carboxybenzothiazole, 5-ethoxycarbonylbenzothiazole, 5-hydroxybenzothiazole, 5-phenylbenzothiazole, 6-phenylbenzothiazole, 5-methoxybenzothiazole, 6-methoxybenzothiazole, 5-iodobenzothiazole, 6-ethoxybenzothiazole, tetrahydrobenzothiazole, 5,6-dimethylbenzothiazole, 5,6-dimethoxybenzothiazole, 5,6-dioxymethylenebenzothiazole, 6-ethoxy-5-methylbenzothiazole, 5-phenethylbenzothiazole, naphtho[1,2-d]thiazole, naphtho[2,1-d]thiazole, naphtho[2.3-d]thiazole, 5-methoxynaphtho[1,2-d]thiazole, 5-methoxynaphtho[2,1-d]thiazole, 8-methoxynaphtho[2,1-d]thiazole, 7-methoxynaphtho[2,1-d]thiazole, 5-methoxythionaphtheno[6,7-d]thiazole, 5-methoxythionaphtheno[6,7-d]-8.9-dihydronaphtho[1,2-d]thiazole and 4,5-dihydronaphtho[2,1-d]thiazole; oxazolic nuclei such as 4-methyloxazole, 5-methyloxazole, 4-phenyloxazole, 4,5-dimethyloxazole, 5-phenyloxazole, 5,6-diphenyloxazole, benzoxazole, 5-chlorobenzoxazole, 5-methylbenzoxazole, 5-phenylbenzoxazole, 6-methylbenzoxazole, 5,6-dimethylbenzoxazole, 5-methoxybenzoxazole, 5-ethoxybenzoxazole, 5-phenethylbenzoxazole, 5-hydroxybenzoxazole, ethoxycarbonylbenzoxazole, 5-bromobenzoxazole, 5-methyl-6-chlorobenzoxazole, naphtho[1,2-d]oxazole, naphtho[2,1-d]oxazole and naphtho[2,3-d]oxazole; selenazolic nuclei such as 4-methylselenazole, 4-phenylselenazole, benzoselenazole, 5-chlorobenzoselenazole, 5-methoxybenzoselenazole, 5-methylbenzoselenazole, tetrahydrobenzoselenazole, naphtho[1,2-d]selenazole, and naphtho[2,1-d]selenazole; tetrazolic nuclei such as 4-phenyltetrazole, 4-methyltetrazole, benzotetrazole, 5-methylbenzotetrazole, 5-methoxybenzotetrazole, 5,6-dimethylbenzotetrazole, naphtho[2,1-d]tetrazole and naphtho[1,2-d]tetrazole; pyridinic nuclei such as 2-pyridine, 5-methyl-2-pyridine, 4-pyridine and 3-methyl-4-pyridine; quinolinic nuclei such as 2-quinoline, 6-methyl-2-quinoline, 5-ethyl-2-quinoline, 6-chloro-2-quinoline, 8-chloro-2-quinoline, 6-methoxy-2-quinoline, 8-ethoxy-2-quinoline, 6-methyl-2-quinoline, 8-fluoro-2-quinoline, 6-dimethylamino-2-quinoline, 4-quinoline, 6-methoxy-4-quinoline, 7-methyl-4-quinoline, and 8-chloro-4-quinoline; 3,3-dialkylindolenic nuclei such as 3,3-dimethylindolenine, 3,3,5-trimethylindolenine, 3,3-dimethyl-5-(dimethylamino)indolenine and 3,3-diethylindolenine; imidazolic nuclei such as imidazole, 1-alkylimidazole, 1-alkyl-4-phenylimidazole, 1-alkyl-4,5-dimethylimidazole, 1-alkylbenzimidazole, 1-phenyl-5,6-dichlorobenzimidazole, 1-alkyl-5-cyanobenzimidazole, 1-alkyl-5-chlorobenzimidazole, 1-alkyl-5,6-dichlorobenzimidazole, 1-alkyl-5-chloro-6-cyanobenzimidazole, 1-alkyl-5-trifluoromethylbenzimidazole, 1-alkyl-5-methylsulfonylbenzimidazole, 1-alkyl-5-methoxycarbonylbenzimidazole, 1-alkyl-5-acetylbenzimidazole, 1-alkyl-5-(N,N-dimethylamino)sulfonylbenzimidazole, 1-alkylnaphtho[1,2-d]imidazole, 1-alkylnaphtho[2,1-d]imidazole and 1-alkylnaphtho[2,3-d]imidazole.

The 1-alkyl groups mentioned above are alkyl groups having 1–10 carbon atoms, exclusive of the carbon atoms in substituents if they are present. Also included in the category of 1-alkyl groups are those which are substituted by alkoxy groups of $C_{1-6}$, alkoxycarbonyl groups having alkoxy groups of $C_{1-4}$, a carboxyl group, a carbamoyl group, a cyano group, a halogen atom, a sulfo atom, a phenyl group, a substituted phenyl group or a vinyl group. Specific examples of substituents include methyl, ethyl, cyclohexyl, butyl, decyl, 2-methoxyethyl, 3-butoxypropyl, 2-hydroxy-ethoxyethyl, ethoxycarbonylmethyl, carboxymethyl, 2-carboxyethyl, 2-cyanoethyl, 2-carbamoylethyl, 2-hydroxyethyl, 2-fluoroethyl, 2,2,2-trifluoroethyl, 2-sulfoethyl, 3-sulfopropyl, 4-sulfobutyl, phenethyl, benzyl, sulfophenethyl, carboxybenzyl, allyl, etc.

The nuclei formed by $Z_1$ and $Z_2$ may further exemplified by the following: oxazolinic nuclei such as oxazoline and 4,4-dimethyloxazoline; thiazolinic nuclei such as thiazoline and 4-methylthiazoline; isoxazolic nuclei such as isoxazole, benzisoxazole, 5-chlorobenzisoxazole, 6-methylbenzisoxasole, 7-methylbenzoxazole, 6-methoxybenzoxazole and 7-methoxybenzisoxazole; 1,3,4-thiadiazolic nuclei such as 5-methyl-1,3,4-thiadiazole and 5-methylthio-1,3,4-thiadiazole; thienothiazolic nuclei such as thieno[2,3-d]thiazole, thieno[3,2-d]thiazole, thieno[2,3-e]benzothiazole, thieno[3,2-e]benzothiazole and thiazolo[4,5-b]benzothiophene; tetrazolic nuclei such as 1-alkyltetrazole; imidazoquinoxalinic nuclei such as 1-alkylimidazo[4,5-b]quinoxaline, 6.7-dichloro-1-alkylimidazo[4,5-b]quinoxaline and 6-dichloro-1-allylimidazo[4,5-b]quinoxaline; imidazoquinolinic nuclei such as 1-alkylimidazo[4,5-b]quinoline and 6,7-dichloro-1-alkylimidazo[4,5-b]quinoline; pyrrolopyridinic nuclei such as 3,3-dialkyl-3H-pyrrolo[2,3-b]pyridine; pyrrolopyrazinic nuclei such as pyrrolo[2,3-b]pyrazine; and pyridopyridinic nuclei such as pyrido[2,3-b]pyridine.

The methine groups represented by $L_1$–$L_5$ may have substituents exemplified by the following: lower alkyl groups having 1–6 carbon atoms such as methyl, ethyl, propyl and isopropyl; aryl groups such as phenyl, p-tolyl and p-chlorophenyl; alkoxy groups having 1–4 carbon atoms such as methoxy and ethoxy; aryloxy groups such as phenoxy; aralkyl groups such as benzyl and phenethyl; heterocyclic groups such as thienyl and furyl; substituted amino groups such as dimethylamino, tetramethyleneamino and anilino; alkylthio groups such as methylthio; and acidic nucleus containing groups such as malononitrile, alkylsulfonylacetonitrile, cyanomethylbenzofuranylketone or cyanomethylphenylketone, 2-pyrazolin-5-one, pyrazolidin-3,5dione, imidazolin-5-one, hydantoin, 2- or 4-thiohydantoin, 2-iminooxazolin-4-one, 2-oxazolin-5-one, 2-thioxazolidine, 2,4-dione, isoxazolin-5-one, 2-thiazolin-4-one, thiazolidin-4-one, thiazolidine-2,4-dione, rhodanine, thiazolidine-2,4-dithione, isorhodanine, indane-1,3-dione, thiophen-3-one, thiophene-3,1,1-dioxide, indolin-2-one, indolin-3-one, indazolin-3-one, 2-oxoimidazolinium, 3-oxoindazolinium, 5,7-dioxo-6,7-dihydrothiazolo[3,2-a]pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one and pyrido[1,2-a]pyrimidine-1,3-dione. If desired, substituents on the methine chain may combine together to form 4- to 6-membered rings such as a 2-hydroxy-4-oxocyclobutene ring, a cyclopentane ring and a 3,3-dimethylcyclohexene ring.

The alkyl groups represented by $R_1$ and $R_2$ are preferably those having 1–8 carbon atoms, such as methyl, ethyl, butyl and isobutyl. Such alkyl groups may have substituents as exemplified by an alkoxy group, an alkoxycarbonyl group, an aryl group, a hydroxy group, a cyano group, a vinyl group, a halogen atom, a carbamoyl group, a sulfamoyl group, a carboxyl group, a sulfo group, a sulfato group, etc.

The symbol $(X_1)K_1$ is included within the formula (I) in order to indicate the presence or absence of cations or anions that are necessary to neutralize the ionic charges in the dye. Hence, $K_1$ may assume any value of 0 or greater as appropriate for a specific need. Whether a given dye is a cation, an anion or is devoid of net ionic charges will depend on the associated auxochrome and the substituents present. Typical cations are inorganic or organic ammonium ions (e.g. triethylammonium ion and pyridinium ion), alkali metal ions (e.g. sodium ion and potassium ion), and alkaline earth metal ions (e.g. calcium ion and strontium ion). Typical anions are specifically exemplified by halide anions (e.g. chloride ion, bromide ion and iodide ion), substituted arylsulfonic acid ions (e.g. p-toluenesulfonic acid ion and p-chlorobenzenesulfonic acid ion), aryldisulfonic acid ions (e.g. 1,3-benzenedisulfonic acid ion and 1,5-naphthalenedisulfonic acid ion), alkylsulfuric acid ions (e.g. methylsulfuric acid ion), sulfuric acid ion, thiocyanic acid ion, perchloric acid ion, tetrafluoroboric acid ion, picric acid ion, acetic acid ion, and trifluoromethanesulfoacetic acid ion.

Among the compounds represented by the general formula (I), compounds that are represented by the following general formulas (Ia) and (Ib) are particularly preferred:

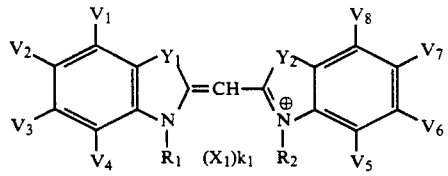
(Ia)

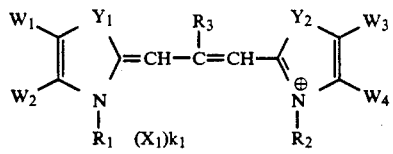
(Ib)

where $R_1$, $R_2$, $X_1$ and $K_1$ have the same meanings as defined in the general formula (I); $Y_1$ and $Y_2$ are each an oxygen atom, a sulfur atom, a selenium atom, a tellurium atom or $$-\overset{|}{N}-R_4;$$

$V_1$–$V_8$ are each a hydrogen atom, an alkyl group (e.g. methyl, ethyl or trifluoromethyl), an alkoxy group (e.g. methoxy or ethoxy), a halogen atom (e.g. F, Cl or Br), a phenyl group, a hydroxyl group, a cyano group, an alkoxycarbonyl group (e.g. methoxycarbonyl or butoxycarbonyl), a carbamoyl group (e.g. carbamoyl or N,N-dimethylaminocarbonyl), a sulfamoyl group (e.g. sulfamoyl or N,N-pentamethyleneaminosulfonyl), or a sulfonyl group (e.g. methanesulfonyl or benzenesulfonyl); $V_1$ and $V_2$, or $V_2$ and $V_3$, or $V_3$ and $V_4$, or $V_5$ and $V_6$, or $V_6$ and $V_7$, or $V_7$ and $V_8$ may combine with each other to form a benzene ring, a cyclohexene ring, a thiophene ring, etc.; $R_4$ is a substituted or unsubstituted alkyl or aryl group.; $W_1$–$W_4$ are each a hydrogen atom, an alkyl group (e.g. methyl or ethyl) or a phenyl group, provided that in a preferred case $W_1$ and $W_2$ and/or $W_3$ and $W_4$ may combine with each other to form a benzene ring, a cyclohexene ring, a thiophene ring or a naphthalene ring, with the following substituents being optionally present on these rings: a halogen atom (e.g. F, Cl or Br), an alkyl group (e.g. methyl or ethyl), an alkoxyl group (e.g. methoxy or ethoxy), an aryl group (e.g. phenyl), a trifluoromethyl group, a cyano group, an alkoxycarbonyl group (e.g. methoxycarbonyl or butoxycarbonyl), a carbamoyl group (e.g. carbamoyl or N,N-dimethylaminocarbonyl), a sulfonyl group (e.g. methanesulfonyl or benzenesulfonyl), a sulfamoyl group (e.g. sulfamoyl or N,N-dimethylaminosulfonyl), etc.; $R_3$ is a hydrogen atom, an alkyl group (e.g. methyl, ethyl, propyl or n-butyl), an aralkyl group (e.g. benzyl), an aryl group (e.g. phenyl or p-tolyl), a heterocyclic group (e.g. 2-furyl or 2-thienyl), an acidic nucleus containing group (e.g. 2,4,6-triketohexahydropyrimidine derivative, pyrazolone derivative, 2-thio-2,4,6-triketohexapyrimidine derivative, hydantoin derivative, indandione derivative, thianaphthenone derivative, or oxazolone derivative).

Specific but by no means limiting examples of the spectral sensitizers to be used in the present invention that are represented by the general formula (I) are listed below.

[Ia-1]
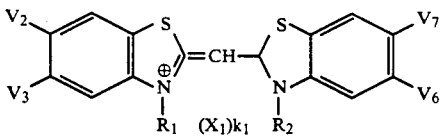
| I-No. | $V_2$ | $V_3$ | $V_6$ | $V_7$ | $R_1$ | $R_2$ | $(X_1)k_1$ |
|---|---|---|---|---|---|---|---|
| 1 | H | Cl | Cl | H | $(CH_2)_4SO_3^{\ominus}$ | $(CH_2)_4SO_3Na$ | — |
| 2 | H | Cl | Cl | H | $(CH_2)_4SO_3^{\ominus}$ | $CH_2COOH$ | — |
| 3 | H | $OCH_3$ | $OCH_3$ | H | $(CH_2)_3SO_3^{\ominus}$ | $(CH_2)_3SO_3Na$ | — |
| 4 | H | H | H | H | $(CH_2)CH(SO_3^{\ominus})CH_3$ | $CH_2CH{=}CH$ | — |
| 5 | H | $OCH_3$ | OH | H | $(CH_2)_2SO_3^{\ominus}$ | $(CH_2)_2SO_3Na$ | — |
| 6 | $CH_3$ | $CH_3$ | Cl | H | $(CH_2)_2COOH$ | $(CH_2)_3SO_3^{\ominus}$ | — |
I-7
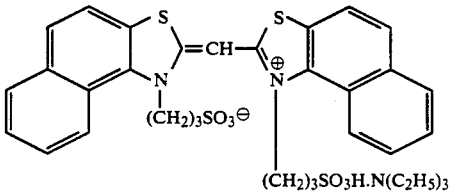
I-8
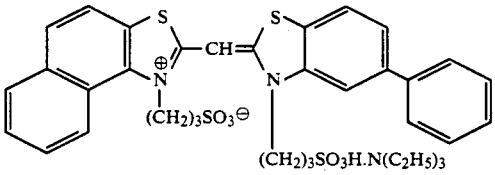
I-9
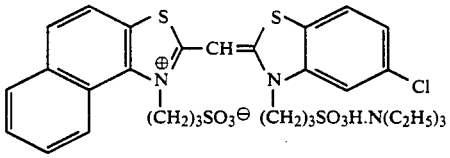
I-10
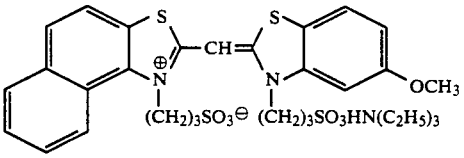
I-11
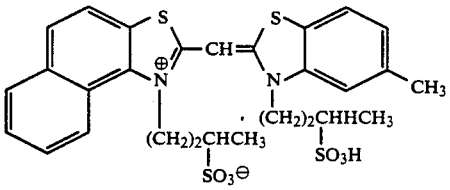
I-12
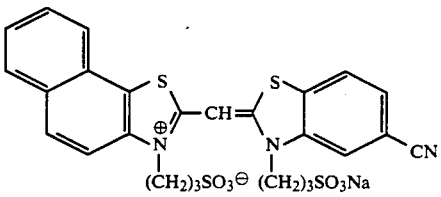

-continued
I-13
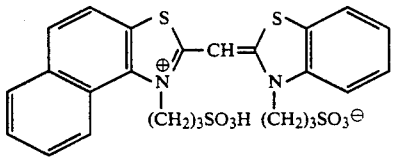
I-14
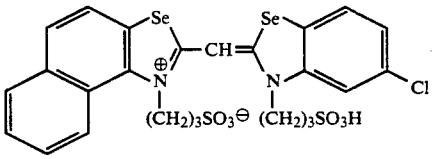
I-15
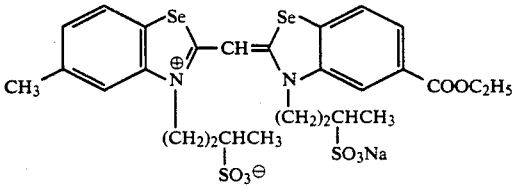
I-16
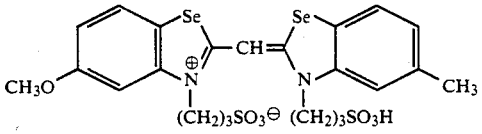
I-17
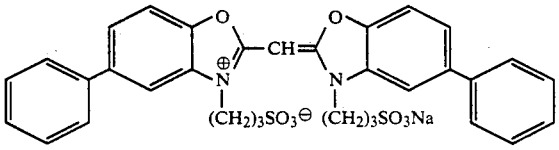
I-18
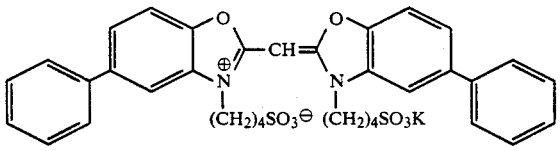
I-19
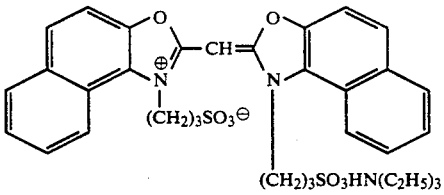
I-20
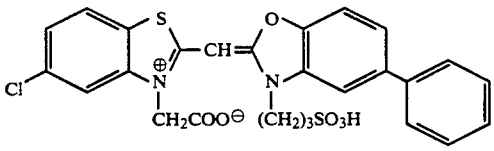
I-21
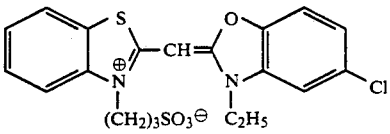

-continued
I-22
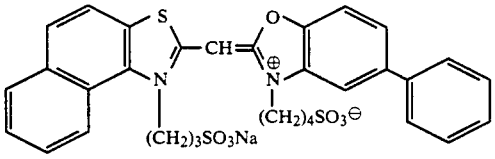
I-23
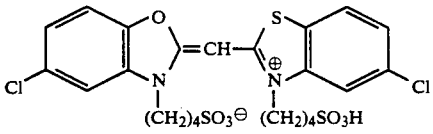
I-24
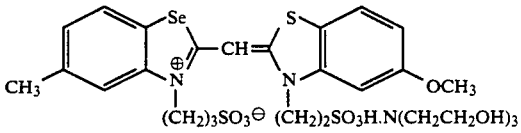
I-25
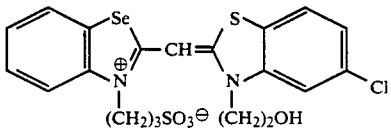
I-26
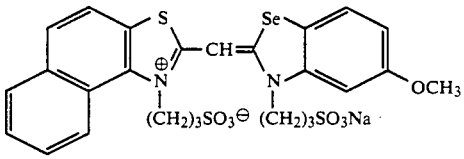
I-27
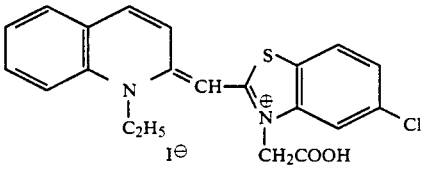
I-28
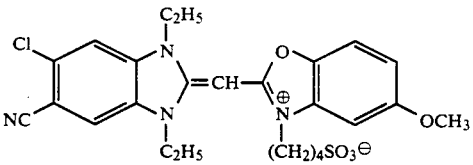
I-29
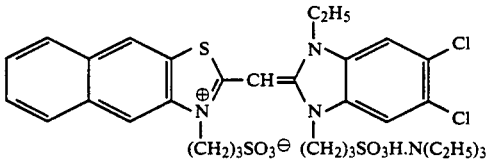
I-30
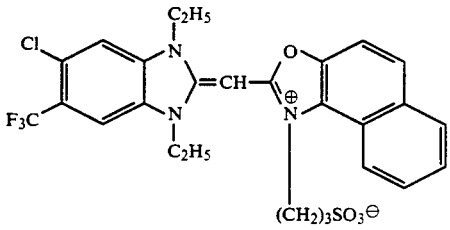

[Ib-1]

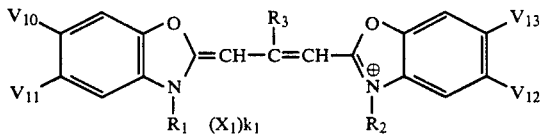

| I-No. | $V_{10}$ | $V_{11}$ | $V_{12}$ | $V_{13}$ | $R_1$ | $R_2$ | $R_3$ | $(X_1)k_1$ |
|---|---|---|---|---|---|---|---|---|
| 31 | H | $COCH_3$ | $COCH_3$ | H | $(CH_2)_3SO_3^{\ominus}$ | $(CH_2)_3SO_3Na$ | $C_2H_5$ | — |
| 32 | H | | | H | $(CH_2)_4SO_3^{\ominus}$ | $(CH_2)_4SO_3H.N(C_2H_5)_3$ | $C_2H_5$ | — |
| 33 | H | | Cl | H | $(CH_2)_2CH(SO_3^{\ominus})CH_3$ | $(CH_2)_3SO_3H.N(C_2H_5)_3$ | $C_2H_5$ | — |
| 34 | H | Cl | Cl | H | $(CH_2)_3SO_3^{\ominus}$ | $(CH_2)_3SO_3H.N(C_2H_5)_3$ | $C_2H_5$ | — |
| 35 | H | | | H | $(CH_2)_3SO_3^{\ominus}$ | $(CH_2)_3SO_3H.N$ | $C_2H_5$ | — |
| 36 | H | $OCH_3$ | $OCH_3$ | H | $(CH_2)_3SO_3^{\ominus}$ | $C_2H_5$ | $C_2H_5$ | — |
| 37 | H | $COOC_2H_5$ | $COOC_2H_5$ | H | $(CH_2)_3SO_3^{\ominus}$ | $C_2H_5$ | $C_2H_5$ | — |
| 38 | H | | | H | $(CH_2)_2SO_3^{\ominus}$ | $(CH_2)_2SO_3Na$ | $C_2H_5$ | — |
| 39 | H | Cl | Cl | $CH_3$ | $(CH_2)_3SO_3^{\ominus}$ | $(CH_2)_4SO_3H.N(C_2H_5)_3$ | $C_2H_5$ | — |
| 40 | H | Cl | Cl | H | $C_2H_5$ | $(CH_2)_3SO_3^{\ominus}$ | $C_2H_5$ | — |
| 41 | H | | | H | $C_2H_5$ | $C_2H_5$ | | $I^{\ominus}$ |
| 42 | H | | t-$C_5H_{11}$ | H | $(CH_2)_2SO_3^{\ominus}$ | $(CH_2)_4SO_3H.N(C_2H_5)_3$ | $C_2H_5$ | — |
| 43 | H | | $CH_2$— | H | $(CH_2)_3SO_3^{\ominus}$ | $(CH_2)_3SO_3Na$ | $C_2H_5$ | — |
| 44 | H | | H | t-$C_4H_9$ | $(CH_2)_3SO_3^{\ominus}$ | $(CH_2)_3SO_3K$ | $C_2H_5$ | — |
| 45 | H | F | F | H | $(CH_2)_2NH(SO_2CH_3)$ | $(CH_2)_4SO_3^{\ominus}$ | H | — |
| 46 | H | | | H | $(CH_2)_2SO_3^{\ominus}$ | $(CH_2)_2SO_3H.N$ | H | — |
| 47 | H | Br | Br | H | $(CH_2)_4SO_3^{\ominus}$ | $(CH_2)_4SO_3Na$ | $C_3H_7$ | — |

-continued
| | | | | | | | |
|---|---|---|---|---|---|---|---|
| 48 | H | 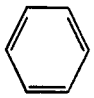 | Cl | H | $(CH_2)_2SO_3^{\ominus}$ | $(CH_2)_3SO_3H.N(C_2H_5)_3$ | $C_2H_5$ | — |
I-49
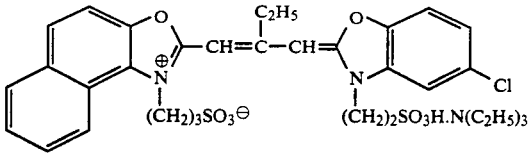
I-50
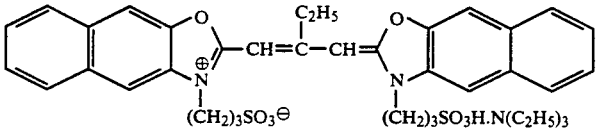
I-51
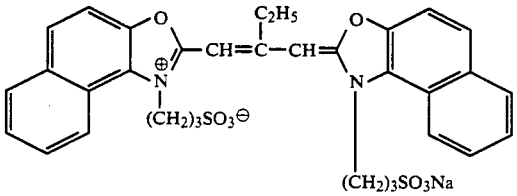
I-52
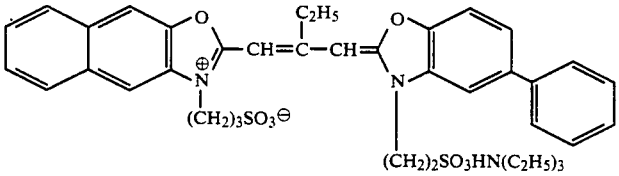
I-53
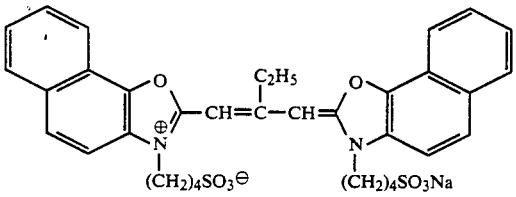
I-54
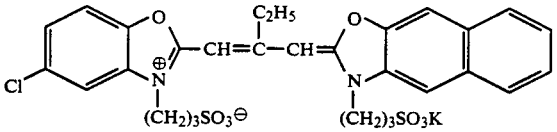
I-55
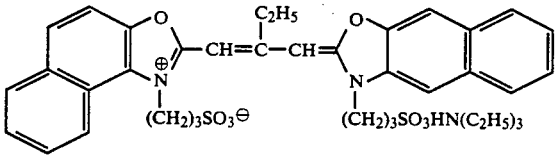
I-56
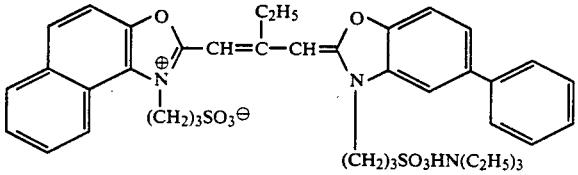

-continued
I-57
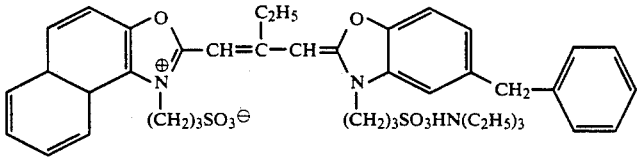
I-58
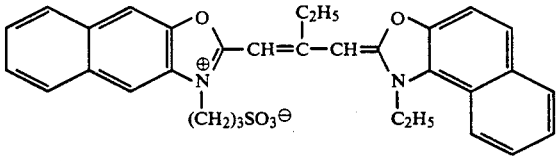
I-59
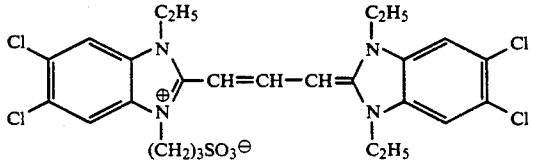
I-60
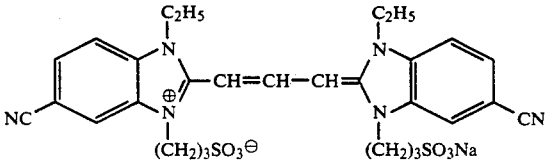
I-61
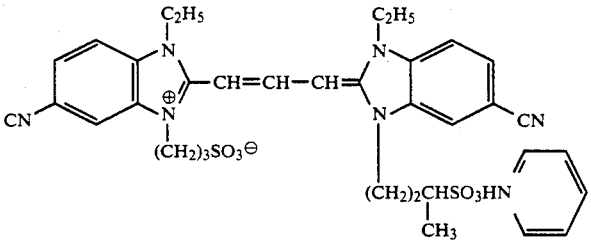
I-62
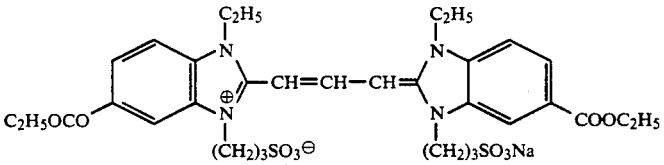
I-63
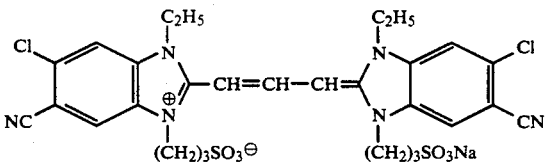
I-64
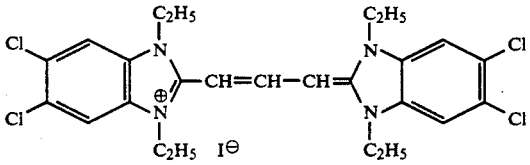
I-65
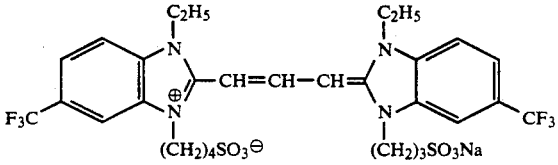

-continued
I-66
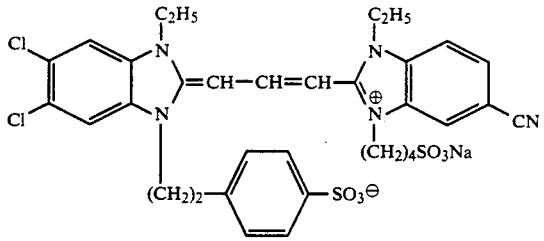
I-67
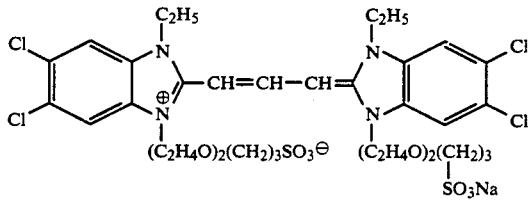
I-68
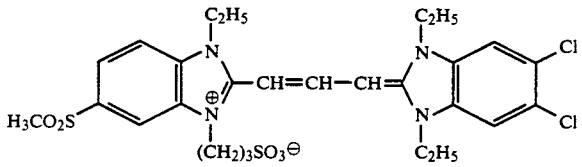
I-69
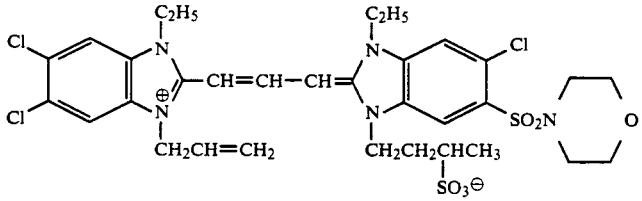
I-70
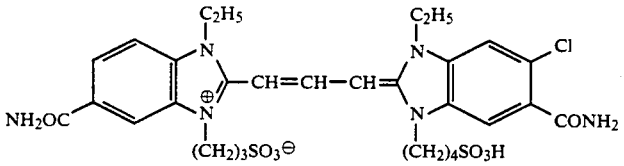
I-71
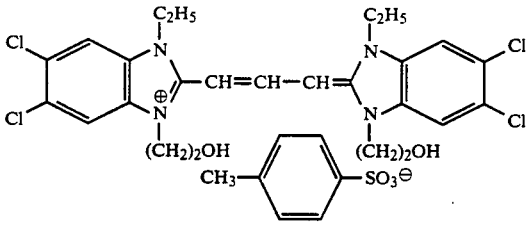
I-72
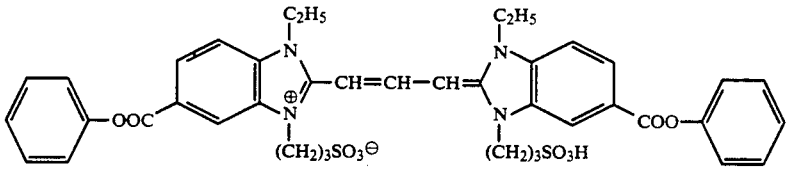
I-73
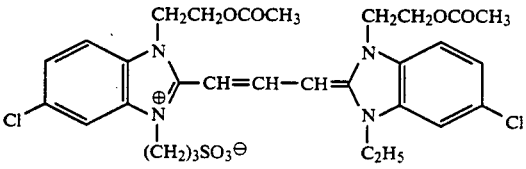

-continued
I-74
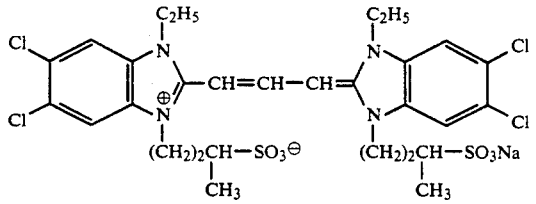
I-75
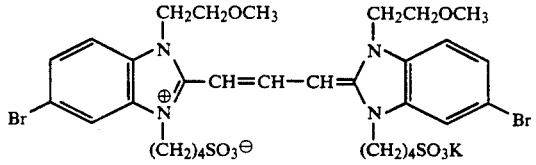
I-76
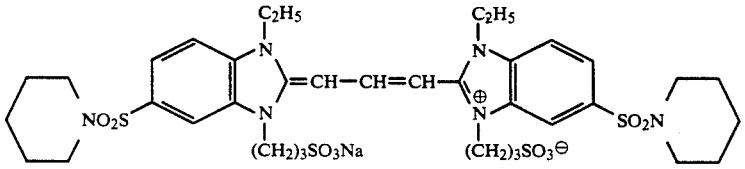
I-77
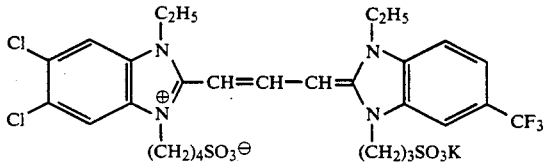
I-78
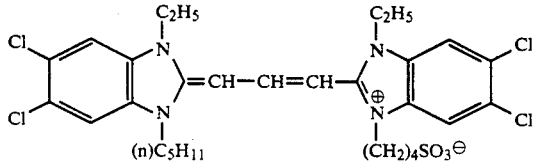
I-79
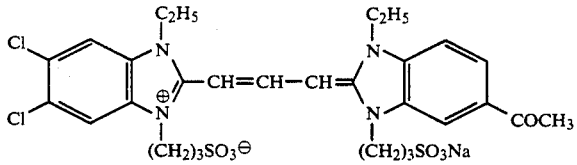
I-80
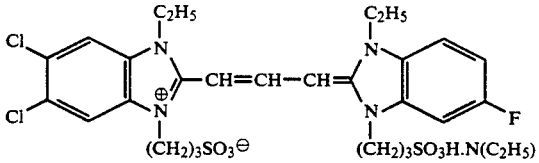
I-81
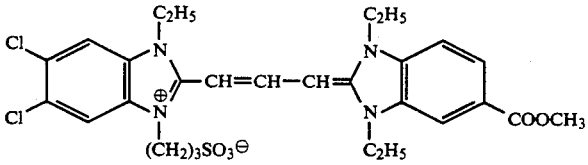
I-82
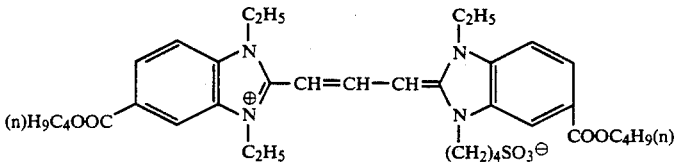

-continued

I-83

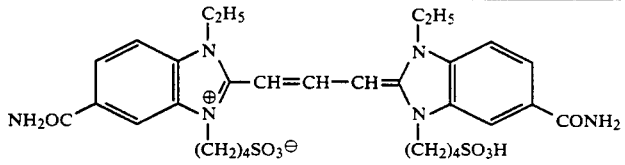

[Ib-2]

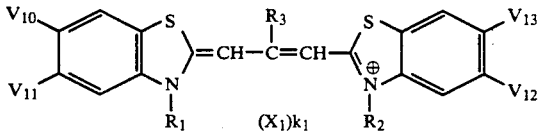

| I-No. | $V_{10}$ | $V_{11}$ | $V_{12}$ | $V_{13}$ | $R_1$ | $R_2$ | $R_3$ | $(X_1)k_1$ |
|---|---|---|---|---|---|---|---|---|
| 84 | H | H | H | H | $C_2H_5$ | $CH_3$ | $CH_3$ | $ClO_4^{\ominus}$ |
| 85 | $OCH_3$ | $OCH_3$ | H | $CH_3$ | $(CH_2)_3SO_3^{\ominus}$ | $(CH_2)_4SO_3H.N(C_2H_5)_3$ | $CH_3$ | — |
| 86 | H | $COOC_2H_5$ | $CF_3$ | H | $C_2H_5$ | $C_2H_5$ | $C_2H_5$ | $I^{\ominus}$ |
| 87 | H | Cl | Cl | H | $(CH_2)_3SO_3^{\ominus}$ | $(CH_2)_3SO_3H.N(C_2H_5)_3$ | $C_2H_5$ | — |
| 88 | H | Cl | Cl | H | $(CH_2)_3SO_3^{\ominus}$ | $C_2H_5$ | $C_2H_5$ | — |
| 89 | H | Cl | Cl | H | $(CH_2)_4SO_3^{\ominus}$ | $C_2H_5$ | $C_2H_5$ | — |
| 90 | H | Cl | Cl | H | $(CH_2)_2COOH$ | $(CH_2)_3SO_3^{\ominus}$ | $C_2H_5$ | — |
| 91 | H | $OCH_3$ | H | H | $(CH_2)_4SO_3^{\ominus}$ | $C_2H_5$ | $CH_3$ | — |
| 92 | H | OH | OH | H | $(CH_2)_3SO_3^{\ominus}$ | 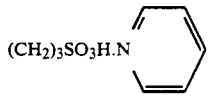 | $C_2H_5$ | — |
| 93 | H | $CH_3$ | $CH_3$ | H | $(CH_2)_3SO_3^{\ominus}$ | $(CH_2)_3SO_3H$ | $C_2H_5$ | — |
| 94 | H | $OCH_3$ | $OCH_3$ | H | $(CH_2)_4SO_3^{\ominus}$ | $(CH_2)_4SO_3H.N(C_2H_5)_3$ | $C_2H_5$ | — |
| 95 | H | Cl | Cl | H | $C_2H_5$ | $(CH_2)_2CH(CH_3)SO_3^{\ominus}$ | $C_2H_5$ | — |

I-96

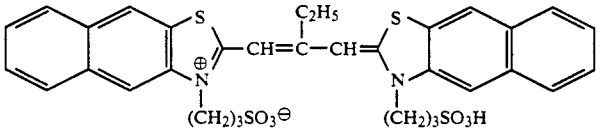

I-97

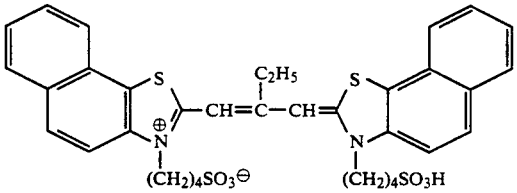

I-98

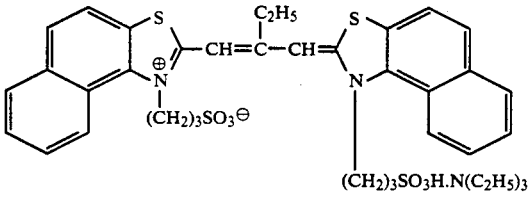

I-99

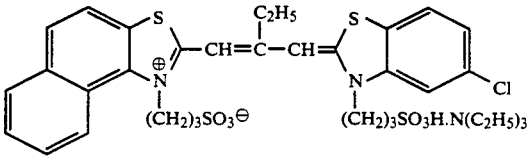

-continued
I-100
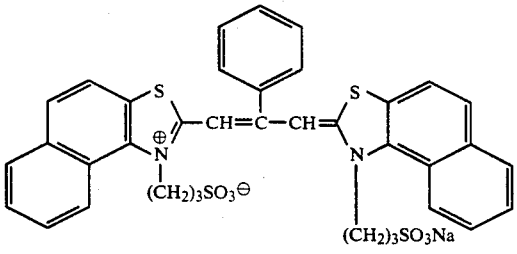
I-101
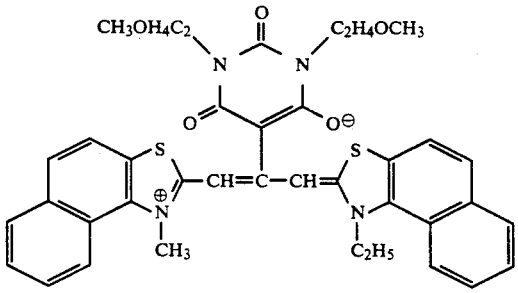
I-102
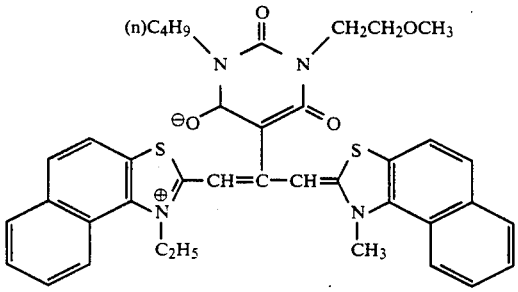
I-103
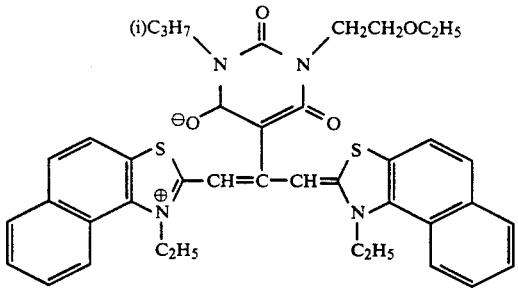
I-104
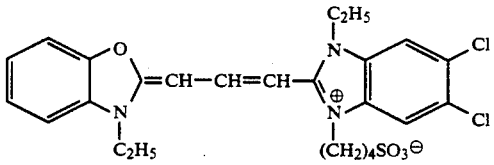
I-105
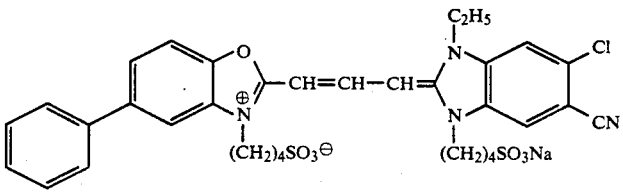

-continued
I-106
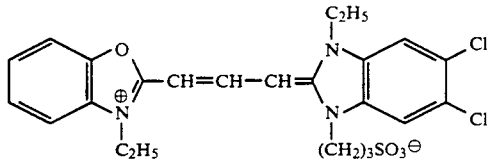
I-107
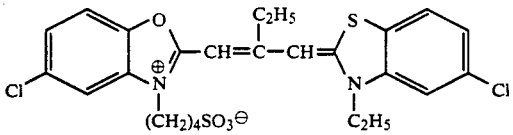
I-108
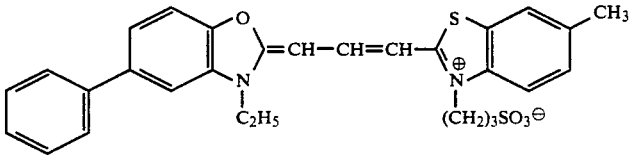
I-109
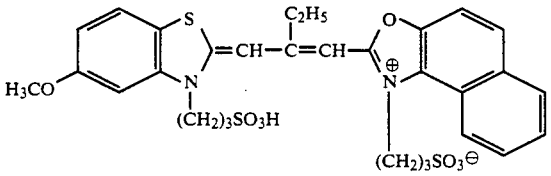
I-110
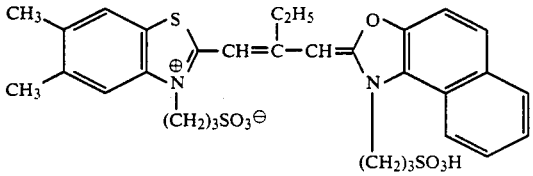
I-111
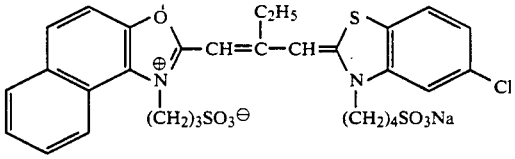
I-112
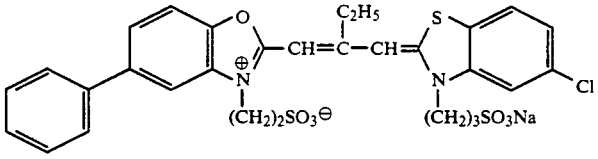
I-113
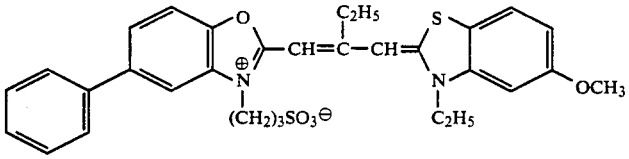
I-114
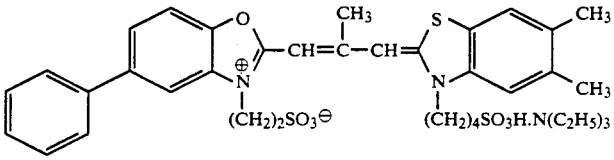

-continued
I-115
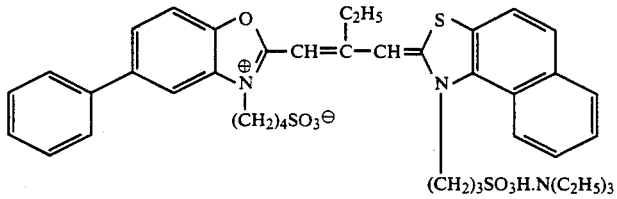
I-116
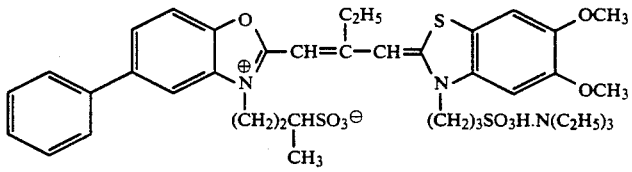
I-117
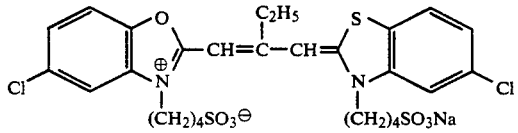
I-118
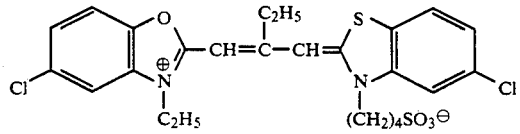
I-119
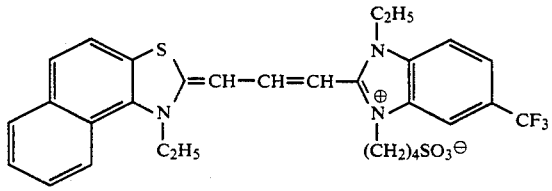
I-120
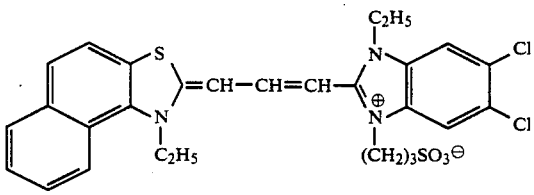
I-121
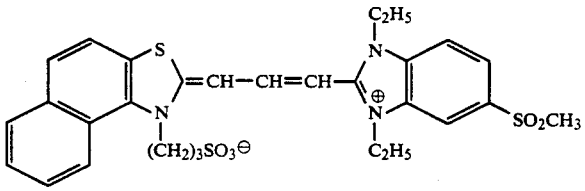
I-122
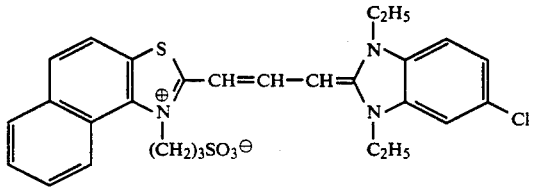

-continued
I-123
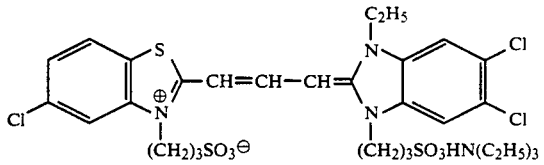
I-124
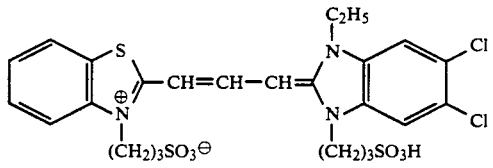
I-125
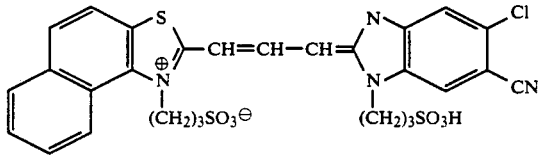
I-126
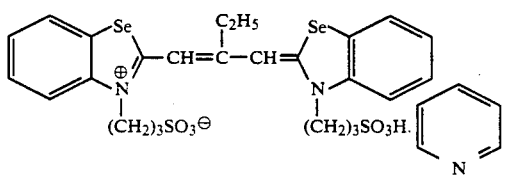
I-127
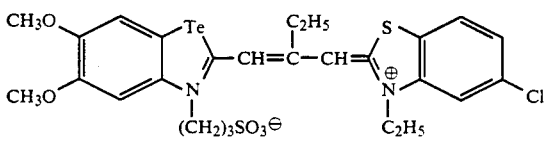
I-128
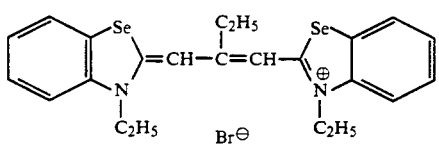
I-129
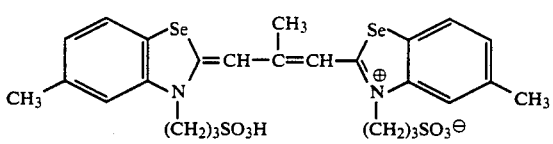
I-130
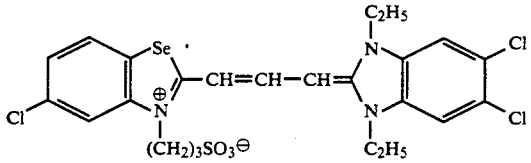
I-131
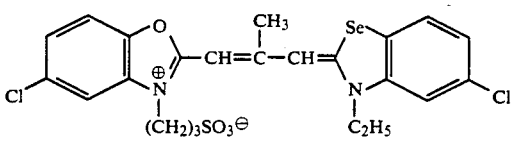

-continued
I-132
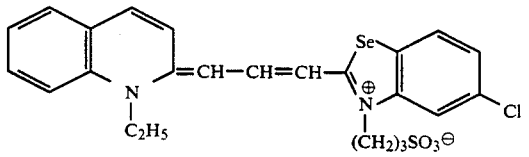
I-133
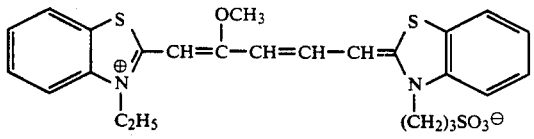
I-134
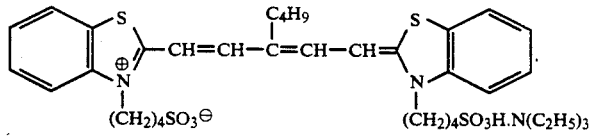
I-135
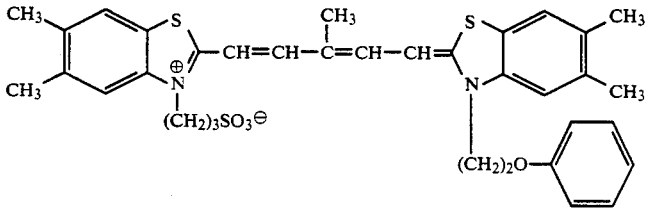
I-136
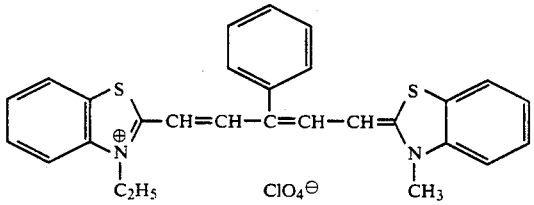
I-137
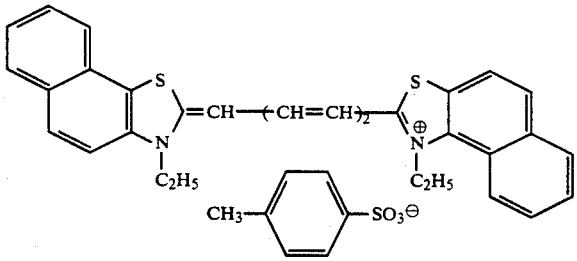
I-138
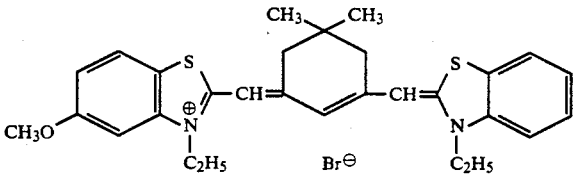
I-139
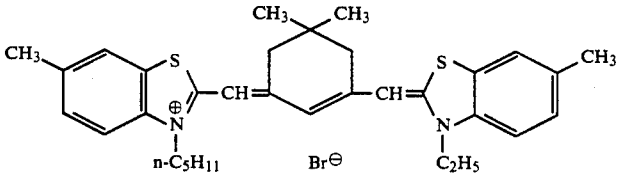

-continued
I-140
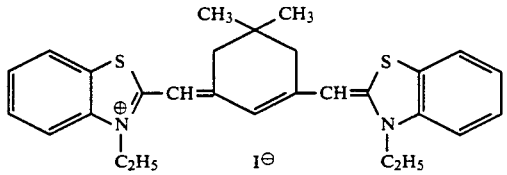
I-141
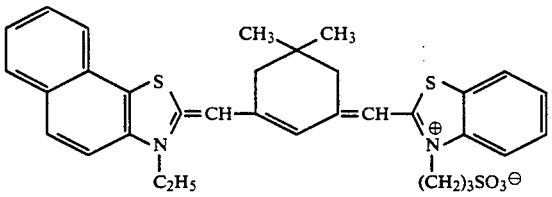
I-142
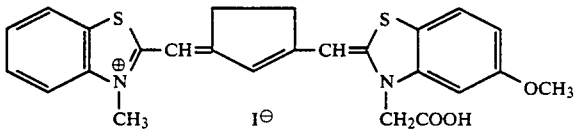
I-143
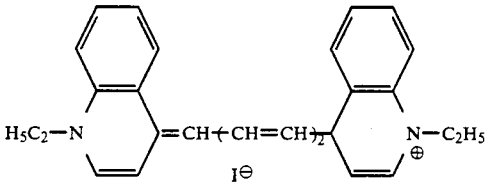
I-144
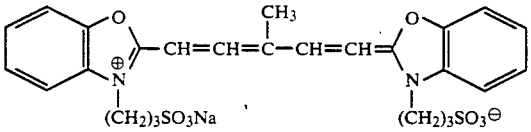
I-145
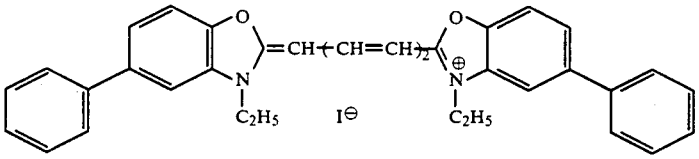
I-146
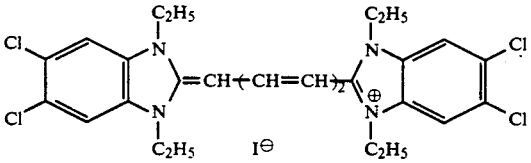
I-147
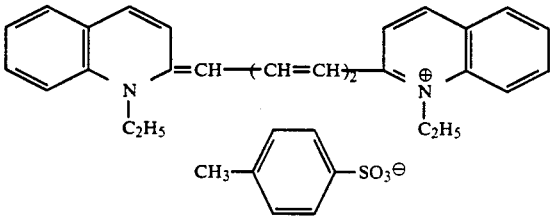

-continued
I-148
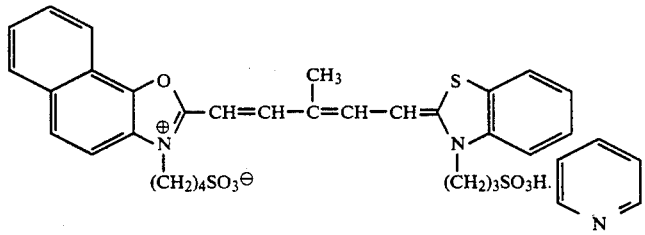
I-149
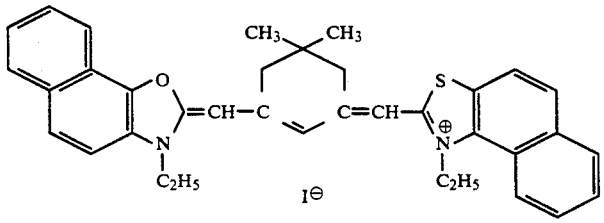
I-150
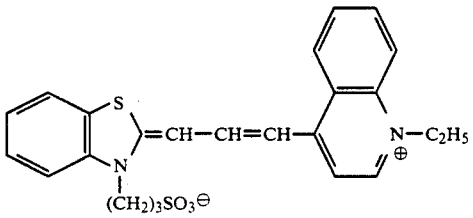
I-151
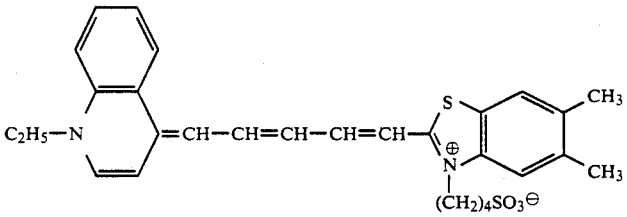
I-152
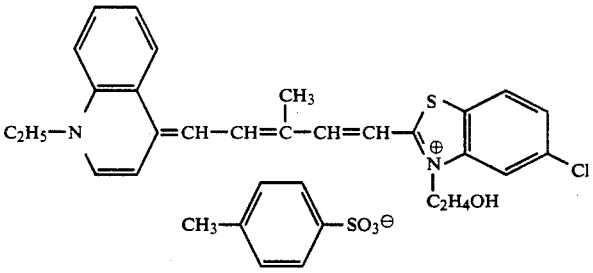
I-153
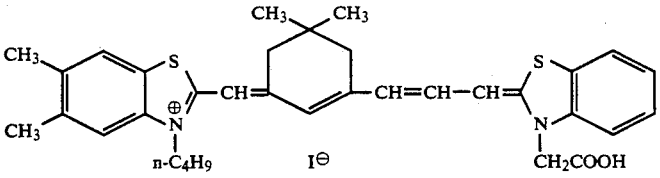
I-154
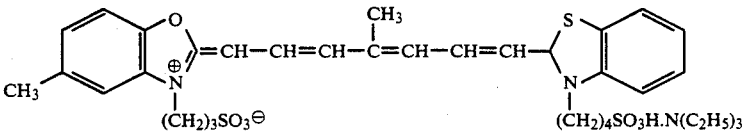

-continued

I-155

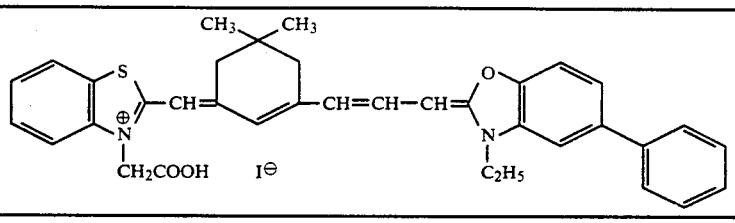

The spectral sensitizers represented by the general formula (I) can be easily synthesized by one skilled in the art if he makes reference to the methods described in various prior art documents including J. Am. Chem. Soc., 67, 1875–1899 (1945), F. M. Hamer, "The Chemistry of Heterocyclic Compounds", Vol. 18, "The Cyanine Dyes and Related Compounds", ed. by A. Weissberger, Interscience, New York, 1964, U.S. Pat. Nos. 3,483,196, 3,541,089, 3,598,595, 3,632,808, 3,757,663, and JP-A-60-78445 (the term "JP-A" as used herein means an "unexamined published Japanese patent application").

Optimal concentrations of the spectral sensitizers represented by the general formula (I) can be determined by any of the methods known to one skilled in the art. According to one method, a given emulsion is divided into two parts, a selected spectral sensitizer is incorporated at different concentrations in the two parts, and the performance of each part of the emulsion is measured to determine an optimum concentration of that emulsion.

The amounts in which the spectral sensitizers of the general formula (I) are to be added are not limited to any particular values but they are preferably used in amounts ranging from $2\times10^{-6}$ to $1\times10^{-2}$ mole per mole of silver halide, with the range of $5\times10^{-6}$ to $5\times10^{-3}$ moles per mole of silver halide being particularly preferred.

The spectral sensitizers of the general formula (I) may be incorporated into emulsions by any of the methods well known in the art. For example, they may be directly incorporated in emulsions. Alternatively, they are first dissolved in water-soluble solvents such as pyridine, methyl alcohol, ethyl alcohol, methyl cellosolve, acetone, fluorinated alcohols, dimethylformamide and mixtures thereof. They may also be diluted with or dissolved in water. The resulting various forms of solution may be added to emulsions. If desired, ultrasonic vibrations may be applied during the preparation of such solutions.

Spectral sensitizers or sensitizing dyes may be incorporated into emulsions by other methods as described in U.S. Pat. No. 3,469,987 (dyes are dissolved in volatile organic solvents, the resulting solution is dispersed in a hydrophilic colloid, and the dispersion thus formed is added to emulsions) and JP-B-46-24185 (the "JP-A" as used herein means an "examined Japanese patent publication") (water-insoluble dyes are dispersed, rather than dissolved in water-soluble solvents, and the resulting dispersion is incorporated in emulsions). Still other methods that can be employed are described in U.S. Pat. Nos. 2,912,345, 3,342,605, 2,996,287, 3,425,835, etc.

The spectral sensitizers of the general formula (I) which are to be used in the present invention may be added to emulsions at any stage of the manufacturing process starting with the formation of silver halide grains and ending just prior to coating on a support. Stated more specifically, the spectral sensitizers may be added at any of the following stages: prior to the formation of silver halide grains; during the formation of silver halide grains; during the period from the end of the formation of silver halide grains to the start of chemical sensitization; at the start of chemical sensitization; during chemical sensitization; at the end of chemical sensitization; and during the period from the end of chemical sensitization to the start of coating operation. If necessary, the sensitizers may be added in divided stages rather than at a time. The order of adding stabilizers and antifoggants is not critical but preferably they are added during the formation of silver halide grains or chemical ripening, namely at a stage prior to the preparation of coating solutions.

The spectral sensitizers of the general formula (I) may be combined with either themselves or other spectral sensitizers to achieve supersensitization. In such combinations for supersensitization, the respective spectral sensitizers are dissolved in the same or different solvents and the resulting solutions are added to emulsions either separately or as an admixture. When the solutions are to be added separately, the order of addition and the interval between additions may be determined as appropriate for a specific object.

The compounds represented by the general formulas (II) and (III) are described below. Preferred examples of the substituents represented by $V_{21}$, $V_{22}$, $V_{23}$ and $V_{24}$ include a halogen atom (e.g. Cl), an aryl group (e.g. phenyl), an alkyl group (e.g. preferably $C_{1-7}$, more preferably $C_{1-4}$), an alkoxy group (preferably $C_{1-6}$, more preferably $C_{1-2}$), and an alkoxycarbonyl group (e.g. ethoxycarbonyl). It is also preferred that two adjacent substituents are condensed to form a benzene ring. When $Z_3$ is $$-\overset{|}{N}-R_{26},$$

a cyano group is also preferably used as $V_{21}$, $V_{22}$, $V_{23}$ or $V_{24}$.

Preferred examples of the substituents represented by $R_{21}$, $R_{22}$, $R_{23}$, $R_{24}$ and $R_{25}$ include a halogen atom (e.g. Cl), a hydroxyl group, and an alkyl and an alkoxy group having 1–4 carbon atoms. It is also preferred that two adjacent substituents are condensed to form a ring (e.g. condensed benzene ring or methylenedioxy group).

The alkyl group represented by $R_{26}$ is preferably an alkyl group having 1–6 carbon atoms such as methyl, ethyl or propyl, and such alkyl groups may have substituents such as an alkoxy group, an alkylthio group, an aryloxy group, an aryl group, a hydroxyl group, a cyano group, a vinyl group, a halogen atom, a carbamoyl group, a sulfamoyl group, a sulfonyl group, an alkoxycarbonyl group, a carboxyl group, etc.

In the general formula (III), $V_{31}$–$V_{34}$ have the same meansings as $V_{21}$–$V_{24}$, and $R_{31}$–$R_{35}$ also have the same meanings as $R_{21}$–$R_{25}$. Further, $R_{36}$ has the same meaning as $R_1$ and $R_2$, and $X_2$ and $K_2$ have the same meanings as $X_1$ and $K_1$.

The following are specific but non-limiting examples of the compounds that are represented by the general formulas (II) and (III) and which are to be used in the present invention.

[II-1]

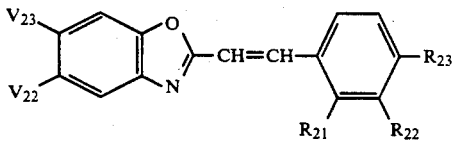

| II-No. | $V_{22}$ | $V_{23}$ | $R_{21}$ | $R_{22}$ | $R_{23}$ |
|---|---|---|---|---|---|
| 1 | H | H | H | H | H |
| 2 | H | H | H | H | Cl |
| 3 | H | H | H | H | OH |
| 4 | H | H | H | H | $CH_3$ |
| 5 | H | H | H | H | $OCH_3$ |
| 6 | H | H | H | H | $OC_2H_5$ |
| 7 | H | H | H | H | 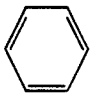 |
| 8 | H | H | H | Cl | H |
| 9 | H | H | Cl | H | H |
| 10 | H | H | OH | H | OH |
| 11 | H | H | H | H | $CH_3$ |
| 12 | 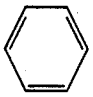 | H | H | H | H |
| 13 | 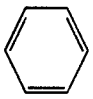 | H | Cl | H | H |
| 14 | H | H | H | H | Cl |
| 15 | H | H | H | H | $OCH_3$ |
| 16 | H | H | H | H | 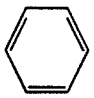 |
| 17 | Cl | H | H | H | H |
| 18 | H | H | H | H | Cl |
| 19 | H | H | H | H | $CH_3$ |
| 20 | H | $CH_3$ | H | H | H |

II-21

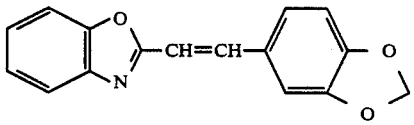

II-22

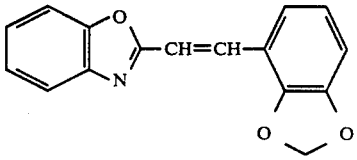

-continued

II-23

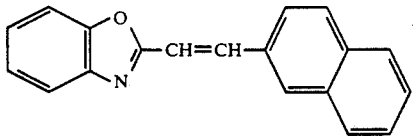

II-24

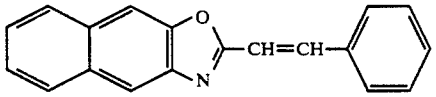

II-25

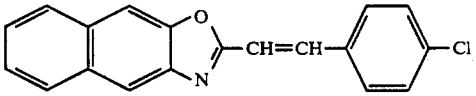

II-26

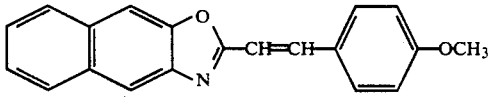

II-27

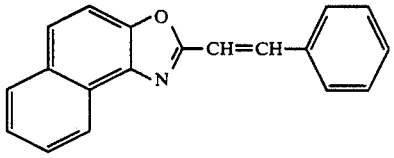

II-28

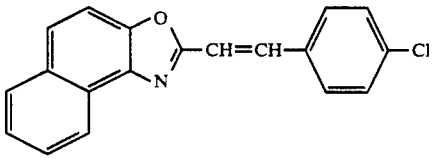

II-29

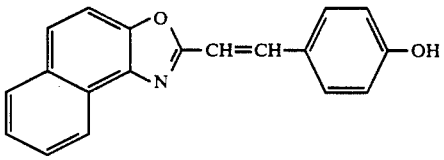

II-30

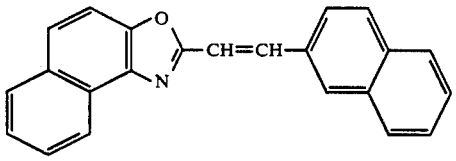

II-31

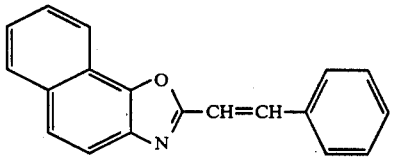

II-32

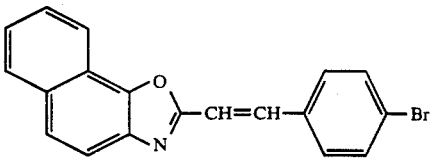

-continued
II-33
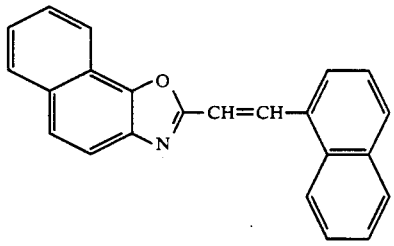
II-34
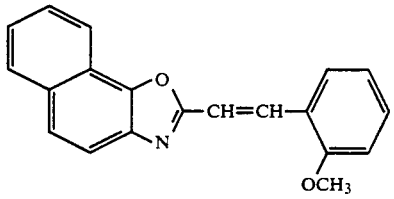
[II-2]
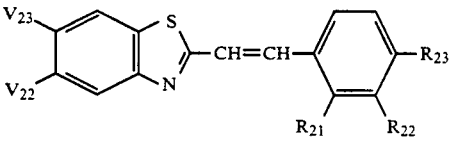
| II-No. | $V_{22}$ | $V_{23}$ | $R_{21}$ | $R_{22}$ | $R_{23}$ |
|---|---|---|---|---|---|
| 35 | H | H | H | H | H |
| 36 | H | H | H | H | Cl |
| 37 | H | H | H | H | OH |
| 38 | H | H | H | H | $OCH_3$ |
| 39 | H | H | H | H | $CH_3$ |
| 40 | Cl | H | H | H | H |
| 41 | Cl | H | H | H | Cl |
| 42 | Cl | H | H | H | $C_2H_5$ |
| 43 | $CH_3$ | H | Cl | H | H |
| 44 | H | $CH_3$ | OH | H | H |
| 45 | $CH_3$ | $CH_3$ | H | H | H |
| 46 | $OCH_3$ | H | H | H | H |
| 47 | $OCH_3$ | $OCH_3$ | H | H | H |
| 48 | 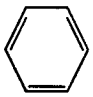 | H | H | H | H |
| 49 | H | H | OH | H | H |
| 50 | H | H | H | OH | H |
II-51
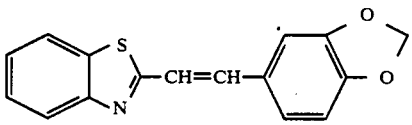
II-52
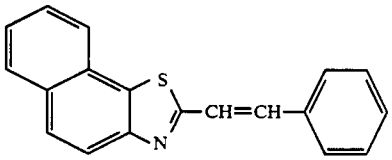
-continued
II-53
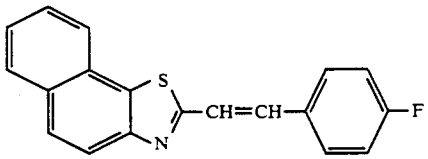
II-54
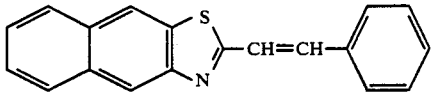
II-55
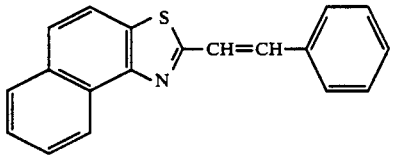
II-56
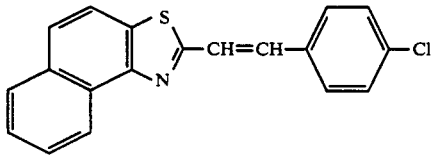
II-57
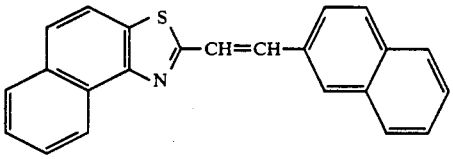
II-58
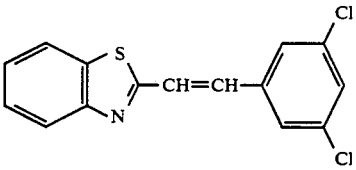
II-59
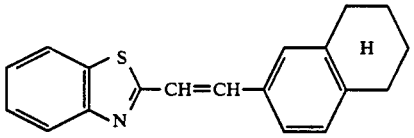
II-60
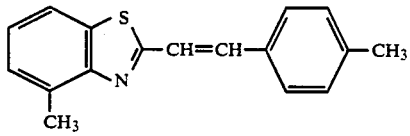
II-61
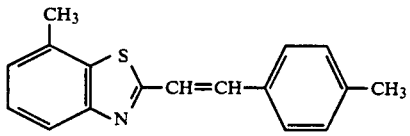
II-62
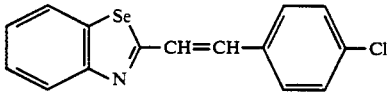

-continued

II-63

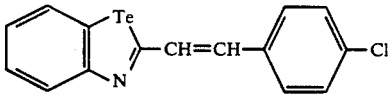

II-64

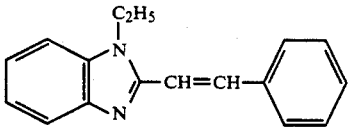

II-65

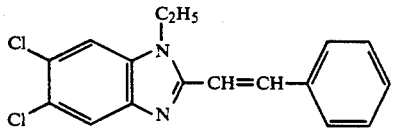

II-66

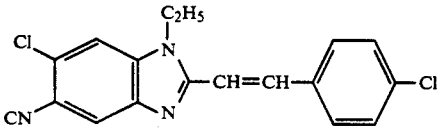

II-67

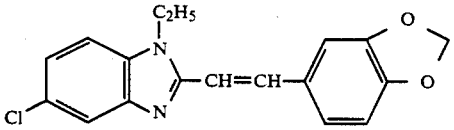

-continued

II-68

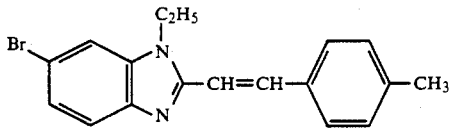

II-69

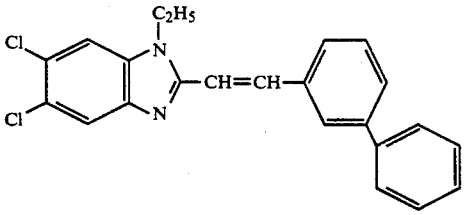

II-70

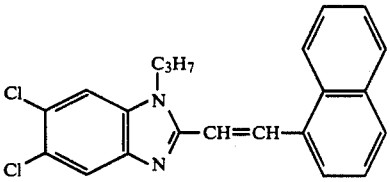

[III-1]

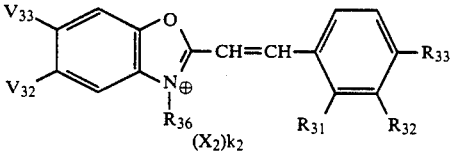

| III-No. | $V_{32}$ | $V_{33}$ | $R_{31}$ | $R_{32}$ | $R_{33}$ | $R_{36}$ | $(X_2)k_2$ |
|---|---|---|---|---|---|---|---|
| 1 | H | H | H | H | H | $C_2H_5$ | $I^{\ominus}$ |
| 2 | H | H | H | H | Cl | $C_2H_5$ | $ClO_4^{\ominus}$ |
| 3 | H | H | H | H | $CH_3$ | $C_2H_5$ | $ClO_4^{\ominus}$ |
| 4 | H | H | H | H | $OCH_3$ | $C_2H_5$ | $I^{\ominus}$ |
| 5 | H | H | H | H | 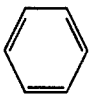 | $C_2H_5$ | $BF_4^{\ominus}$ |
| 6 | H | H | H | $OCH_3$ | H | $CH_3$ | $I^{\ominus}$ |
| 7 | H | H | $OCH_3$ | H | H | $CH_3$ | $I^{\ominus}$ |
| 8 | 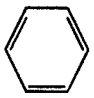 | H | H | H | H | $C_2H_5$ | $I^{\ominus}$ |
| 9 | Cl | H | H | H | H | $C_2H_6$ | $I^{\ominus}$ |
| 10 | $COOC_2H_5$ | H | H | H | H | $C_2H_6$ | $I^{\ominus}$ |
| 11 | 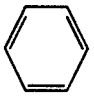 | H | H | H | H | $-CH_2-CH=CH$ | $I^{\ominus}$ |
| 12 | 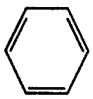 | H | H | H | H | $(CH_2)_3SO_3^{\ominus}$ | — |

-continued

| | | | | | | | |
|---|---|---|---|---|---|---|---|
| 13 | Cl | $CH_3$ | H | H | H | $C_3H_6$ | $Br^{\ominus}$ |
| 14 | H | H | Cl | H | Cl | $CH_3$ | $CH_3$—$C_6H_4$—$SO_3^{\ominus}$ |
| 15 | $CH_3$ | H | H | H | Cl | $CH_3$ | $I^{\ominus}$ |

III-16

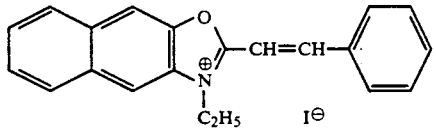

III-17

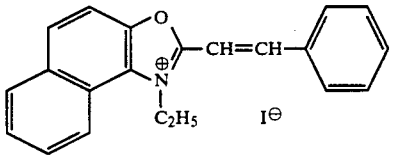

III-18

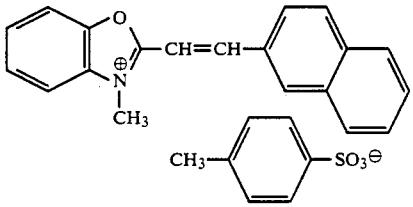

III-19

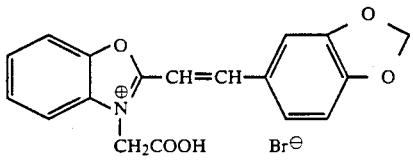

[III-2]

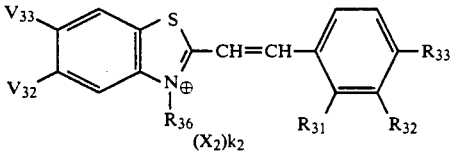

| III-No. | $V_{32}$ | $V_{33}$ | $R_{31}$ | $R_{32}$ | $R_{33}$ | $R_{36}$ | $(X_2)k_2$ |
|---|---|---|---|---|---|---|---|
| 20 | H | H | H | H | H | $C_2H_5$ | $I^{\ominus}$ |
| 21 | H | H | H | H | Cl | $C_2H_5$ | $I^{\ominus}$ |
| 22 | H | H | H | H | OH | $C_2H_5$ | $I^{\ominus}$ |
| 23 | H | H | H | H | $CH_3$ | $C_2H_5$ | $I^{\ominus}$ |
| 24 | H | H | H | H | $C_2H_5$ | $C_2H_5$ | $I^{\ominus}$ |
| 25 | H | H | $OCH_3$ | H | $OCH_3$ | $C_2H_5$ | $I^{\ominus}$ |
| 26 | $CH_3$ | H | H | H | H | $CH_3$ | $ClO_4^{\ominus}$ |
| 27 | H | $CH_3$ | H | H | H | $CH_3$ | $ClO_4^{\ominus}$ |
| 28 | $CH_3$ | $CH_3$ | H | H | H | $CH_3$ | $ClO_4^{\ominus}$ |
| 29 | $OCH_3$ | H | H | H | H | $CH_3$ | $ClO_4^{\ominus}$ |
| 30 | Cl | H | H | H | H | $C_2H_5$ | $ClO_4^{\ominus}$ |
| 31 | Cl | H | H | H | Cl | $C_2H_5$ | $ClO_4^{\ominus}$ |
| 32 | Cl | H | H | Cl | H | $C_2H_5$ | $ClO_4^{\ominus}$ |
| 33 | Cl | H | H | H | H | $(CH_2)_4SO_4^{\ominus}$ | — |
| 34 | Cl | H | H | H | $OC_2H_5$ | $CH_3$ | $I^{\ominus}$ |

-continued
III-35
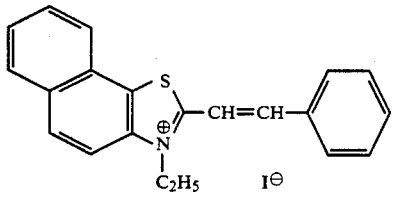
III-36
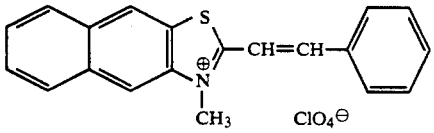
III-37
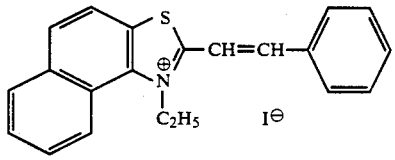
III-38
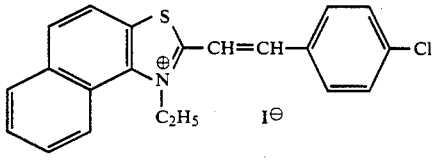
III-39
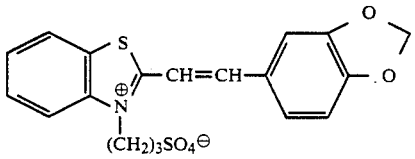
III-40
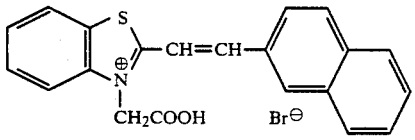
III-41
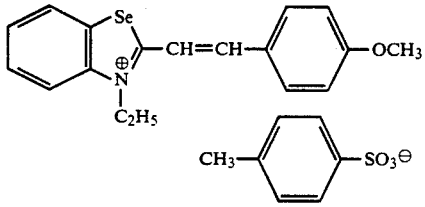
III-42
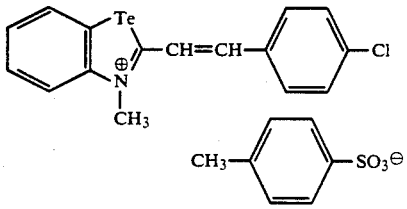

-continued

III-43

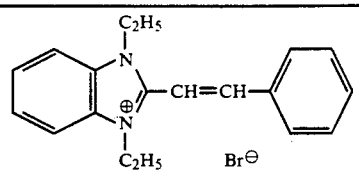

III-44

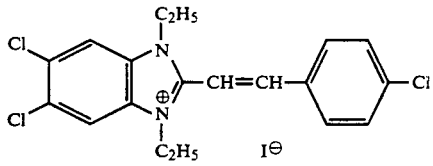

III-45

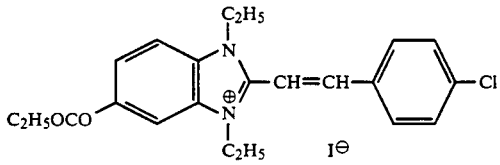

The compounds represented by the general formula (II) or (III) are preferably used in sufficient amounts to achieve supersensitization. It is particularly preferred to use them in amounts ranging from $1\times10^{-8}$ to $1\times10^{-2}$ mole per mole of silver halide in an emulsion.

The molar ratio of the spectral sensitizer of the general formula (I) to the compound of the general formula (II) or (III) is preferably within the range of 10:1 to 1:100, with the range of 2:1 to 1:10 being particularly preferred.

The compounds of the general formula (II) or (III) may be dispersed directly in an emulsion. Alternatively, they may be added to the emulsion after being dissolved in a suitable solvent (e.g. methyl alcohol, ethyl alcohol, methyl cellosolve or water) or a mixed solvent system consisting two or more of those solvents.

It is also possible to add the compounds of (II) or (III) in the form of either a solution or a dispersion in colloid in accordance with customary methods of addition of spectral sensitizers.

The compounds represented by the general formula (II) or (III) may be added simultaneously with or separately from the spectral sensitizers represented by the general formula (I). Preferably, those compounds are added simultaneously with the spectral sensitizers of the general formula (I).

The silver halide grains incorporated in the silver halide photographic material of the present invention may have any halide composition such as silver bromide, silver chloride, silver chlorobromide, silver iodobromide or silver chloroiodobromide. Silver iodobromide is particularly preferred since it provides high sensitivity. In the case of silver iodobromide, the average content of silver iodide in the grains is preferably in the range of 0.5–10 mol %, with the range of 1–8 mol % being more preferred.

The objects of the present invention can be attained more effectively if the silver halide grains incorporated in at least one silver halide emulsion layer which are spectrally sensitized with the dyes of the general formula (I) are adapted to have a core/shell structure. Grains having a core/shell structure are such that the core of a grain is surrounded with a shell having a different composition. In grains having a core/shell structure, the shell may be homogeneous but preferably, a shell on the core is coated with another shell having a different silver halide composition to produce a multilayered shell structure.

If silver halide crystals having a silver iodobromide (or silver chloroiodobromide) core/shell structure are to be used in the present invention, the silver iodide content of the shell preferably ranges from 2 to 40 mol %, with the range of 10–40 mol % being more preferred. The most preferred range is from 15 to 40 mol %.

In preparing silver halide crystals composed of silver iodobromide (or silver chloroiodobromide), iodide ions may be added either as an ionic solution such as a potassium iodide solution or as grains having a smaller solubility product than growing silver halide grains. Preferably, iodide ions are added as silver halide grains having a smaller solubility product than growing silver halide grains.

The silver halide grains to be used in the present invention may be "normal crystals" having a cubic, octahedral, tetradecahedral or spherical shape; alternatively, they may be crystals containing twins. The processes for preparing silver halide grains in the form of normal crystal are known and are described in references such as J. Phot. Sci., 5, 332 (1961), Ber. Bunsenges. Phys. Chem., 67, 949 (1963) and Intern. Congress of Phot. Sci., Tokyo (1967).

Tabular grains having aspect ratios of 5 or more may also be used in the present invention. Tabular grains can be easily prepared by the methods described in U. S. Pat. Nos. 4,434,226, 4,414,310, 4,433,048, 4,439,520, U.K. Pat. No. 2,112,157, etc. Tabular grains for use in the present invention preferably have aspect ratios of 5–100, more preferably 5–20. Such tabular grains preferably have a size of 0.2–30 μm, more preferably 0.4–10 μm, in terms of the diameter of an equivalent circle. Their thickness is preferably 0.5 μm or below, more preferably 0.3 μm or below.

The silver halide emulsions to be used in the present invention may be polydispersed but, more preferably, monodispersed emulsions are used. The term "monodispersed emulsions" as used herein means such silver halide emulsions that at least 95% of the grains are within ±40%, preferably ±30%, of the average grain size in terms of either number or weight when the average grain diameter is measured by the method reported by A. P. H. Trivelli and W. F. Smith in The Photographic Journal, 79, 330–338 (1939).

The above-described silver halide grains to be used in the silver halide photographic material of the present invention can be prepared by the various methods described in T. H. James, "The Theory of the Photographic Process", Fourth Edition, pp. 38–104, Macmillan Publishing Co., New York (1977), including the neutral method, the acid method, the ammoniacal method normal precipitation, reverse precipitation, the double-jet method, the controlled double-jet method, the conversion method, and the core/shell method.

Known photographic additives can be added to the silver halide photographic emulsions for in the present invention. Exemplary photographic additives are the following compounds described in Research Disclosure (RD) Item 17643 and Item 18716.

| Additive | RD-17643 | RD-18716 |
|---|---|---|
| Chemical sensitizer | page 23, III | page 648, upper right column |
| Development accelerator | page 29, XXI | page 648, upper right column |
| Antifoggant | page 24, VI | page 649, lower right column |
| Stabilizer | page 24, VI | page 649, lower right column |
| Anti-color stain agent | page 25, VII | page 650, left and right columns |
| Image stabilizer | page 25, VII | |
| UV Absorber | pages 25–26, VII | page 649, right column to page 650, left column |
| Filter dye | pages 25–26, VII | page 649, right column to page 650, left column |
| Brightening agent | page 24, V | |
| Hardener | page 26, X | page 651, right column |
| Coating aid | pages 26–27, XI | page 650, right column |
| Surfactant | pages 26–27, XI | page 650, right column |
| Plasticizer | page 27, XII | page 650, right column |
| Slip agent | page 27, XII | |
| Antistatic agent | page 27, XII | page 650, right column |
| Matting agent | page 28, XVI | page 650, right column |
| Binder | page 26, IX | page 651, right column |

The photographic material of the present invention can be processed using dye forming couplers that are capable of forming dyes upon coupling with the oxidation products of aromatic primary amino developing agents such as p-phenylenediamine derivatives and aminophenol derivatives. The dye forming couplers are usually selected in such a way as to form dyes that absorb spectral light to which the emulsion layers containing those couplers have sensitivity. Stated more specifically, yellow dye forming couplers are used in a blue-sensitive emulsion layer, magenta dye forming couplers in a green-sensitive emulsion layer, and cyan dye forming couplers in a red-sensitive emulsion layer. However, the silver halide color photographic material of the present invention may adopt other combinations of dye forming couplers and emulsion layers depending on a specific abject.

The dye forming couplers to be used in the present invention desirably have "ballast" groups in their molecules, which "ballast groups" are groups with 8 or more carbon atoms that render the couplers non-diffusible. The dye forming couplers may be of a four-equivalent type which requires four molecules of silver ion to be reduced in order to form a molecule of dye, or they may be of a two-equivalent type which requires only two molecules of silver ion to be reduced in order to form a molecule of dye. Included within the category of dye forming couplers are colored couplers which are capable of color correction, as well as compounds that, upon coupling with the oxidation products of developing agents, release photographically useful fragments such as a development restrainer, a development accelerator, a bleach accelerator, a developing agent, a silver halide solvent, a toning agent, a hardener, a foggant, an antifoggant, a chemical sensitizer, a spectral sensitizer and a desensitizer. Among these couplers and compounds, couplers that release a development retarder as a function of development, thereby improving the sharpness of image and its granularity are called "DIR couplers". Instead of DIR couplers, DIR compounds may be used that enter into a coupling reaction with the oxidation product of a developing agent not only to generate a colorless compound but also to release a development restrainer.

In DIR couplers and DIR compounds that can be used, the development restrainer may be directly bonded to the coupling site or it may be bonded to the coupling site via a divalent group so that it can be released by an intramolecular nucleophilic reaction or an intramolecular electron transfer reaction that occurs within the group leaving upon a coupling reaction. DIR couplers and DIR compounds of the latter type are generally referred to as "timing DIR couplers" and "timing DIR compounds", respectively. The releasable restrainers may be highly diffusible or less diffusible after they leave the coupler, and these two types of restrainers may be used either individually or in combination depending upon a specific use. Dye forming couplers may be used in combination with "competing couplers" which are colorless couplers that couple with the oxidation products of aromatic primary amino developing agents but which will not form a dye.

Known acylacetanilide containing couplers can preferably be used as yellow-dye forming couplers. Among them, benzoylacetanilide and pivaloylacetanilide containing compounds are advantageous.

Specific examples of the yellow color forming couplers that can be used are described U.S. Pat. Nos. 2,875,057, 3,265,506, 3,408,194, 3,551,155 3,582,322, 3,725,072, 3,891,445, German Patent No. 1,547,868, German Patent Application (OLS) Nos. 2,219,917, 2,261,361, 2,414,006, U.K. Patent No. 1,425,020, JP-B-51-10783, JP-A-47-26133, JP-A-48-73147, JP-A-50-6341, JP-A-50-87650, JP-A-50-123342, JP-A-50-130442, JP-A-51-21827, JP-A-51-102636, JP-A-52-82424, JP-A-52-115219, JP-A-58-95346, etc.

Pyrazolone-, indazolone- and cyanoacetyl-containing compounds can be used as magenta color forming couplers, with pyrazolone-containing compounds being particularly advantageous.

Specific examples of the magenta color forming couplers that can be used are described in U.S. Pat. Nos. 2,600,788, 2,983,608, 3,062,653 3,127,269, 3,311.476, 3,419,391, 3,519,429, 3,558,319, 3,582,322, 3,615,506, 3,834,908, 3,891,445, German Patent No. 1,810,464, German Patent Application (OLS) Nos. 2,408,665, 2,417,945, 2,418,959, 2,424,467, JP-B-40-6031, JP-A-51-20826, JP-A-52-58922, JP-A-49-129538, JP-A-49-74027, JP-A-50-159336, JP-A-52-42121, JP-A-49-74028, JP-A-50-60233, JP-A-51-26541, JP-A-53-55122, JP-A-59-171956, JP-A-60-35552, JP-A-60-43659, JP-A-60-172982, JP-A-60-190779, etc.

Phenolic and naphtholic compounds can be used as cyan color forming couplers. Specific examples of the cyan color forming couplers that can be used are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, German Patent Application (OLS) Nos. 2,414,830, 2,454,329, JP-A-48-59838, JP-A-51-26034, JP-A-48-5055, JP-A-51-146828, JP-A-52-69624, etc.

The silver halide photographic material of the present invention can be produced by coating emulsion layers and other necessary photographic layers on supports that have a high degree of flatness and that are dimensionally stable during both production and subsequent photographic processing. Suitable supports include, for example, a nitryl cellulose film, a cellulose ester film, a polyvinyl acetal film, a polystyrene film, a polyethylene terephthalate film, a polycarbonate film, glass, paper, metals, as well as paper coated with polyolefins such as polyethylene and polypropylene. These supports may be subjected to various surface treatments such as one for rendering their surface hydrophilic in order to improve the adhesion to photographic layers such as emulsion layers. Examples of such surface treatments are halogenation, corona discharge treatment, subbing treatment and setting treatment.

The silver halide color photographic material of the present can be processed using known processing solutions by known photographic processing methods as described in Research Disclosure No. 176 (RD-17643), pp. 20–30. The temperature to be used in the photographic processing is usually in the range of 18°–50° C. It should, however, be noted that the photographic material of the present invention can be processed at temperatures either lower than 18° C. or higher than 50° C.

The silver halide color photographic material of the present invention can be applied to various light-sensitive materials including color negative films for picture taking, color reversal films, color papers, color positive films, color reversal papers, direct positive camera materials, heat-processable light-sensitive materials, and silver dye bleachable light-sensitive materials.

The following examples are provided for the purpose of further illustrating the present invention but are in no way to be taking as limiting. In the examples that follow, the amounts of components or additives in silver halide photographic materials are based on one square meter unless otherwise noted. The amounts of silver halides and colloidal silver are calculated for silver. The amounts of spectral sensitizers are expressed in moles per mole of silver. The structures of the compounds used in the examples are collectively shown at the end of Example 4.

EXAMPLE 1

Preparation of sample No. 101

A silver iodobromide emulsion having an average grain size of 0.4 μm and a core with a AgI content of 15 mol % (average AgI content, 8 mol %) was subjected to optimal gold-plus-sulfur sensitization. Thereafter, the emulsion was spectrally sensitized to green by adding illustrative sensitizing dyes I-35 and I-50 in respective amounts of $4.5\times10^{-4}$ and $3\times10^{-4}$ moles per mole of silver. Then, the emulsion was stabilized by addition of 4-hydroxy-6-methyl-1,3,3a,7-tetrazaindene and 1-phenyl-5-mercaptotetrazole.

Subsequently, a magenta coupler (M-1) was dissolved in ethyl acetate and dinonyl phthalate (DNP) and the solution was dispersed in an aqueous solution containing gelatin. Then, customary photographic additives including a spreading agent and a hardener were added to the dispersion, thereby preparing an emulsion coating solution. This coating solution was applied onto a subbed triacetyl cellulose base in the usual manner and dried to prepare a light-sensitive material sample No. 101.

Preparation of sample Nos. 102–115

Sample Nos. 102–115 were prepared by repeating the procedure of preparing sample No. 101 except that the compounds listed in Table 1 were added to the spectral sensitizer used in sample No. 101.

Sample Nos. 101–115 were subjected to wedge exposure in the usual manner and subsequently processed by the following scheme.

| Steps (at 38° C.) | Time |
|---|---|
| Color development | 3 min and 15 sec |
| Bleaching | 6 min and 30 sec |
| Washing with water | 3 min and 15 sec |
| Fixing | 6 min and 30 sec |
| Washing with water | 3 min and 15 sec |
| Stabilizing | 1 min and 30 sec |

The processing solutions used in the color developing, bleaching, fixing and stabilizing steps had the following compositions.

| | |
|---|---|
| Color developing solution | |
| 4-Amino-3-methyl-N-ethyl-N-(β-hydroxyethyl)aniline sulfate | 4.75 g |
| Anhydrous sodium sulfite | 4.25 g |
| Hydroxylamine sulfate | 2.0 g |
| Anhydrous potassium carbonate | 37.5 g |
| Potassium bromide | 1.3 g |
| Nitrilotriacetic acid trisodium salt (monohydrate) | 2.5 g |
| Potassium hydroxide | 1.0 g |
| Water | to make 1,000 ml |
| Bleaching solution | |
| Ethylenediaminetetraacetic acid iron ammonium salt | 100.0 g |
| Ethylenediaminetetraacetic acid diammonium salt | 10.0 g |
| Ammonium bromide | 150.0 g |
| Glacial acetic acid | 10.0 ml |
| Water | to make 1,000 ml |
| pH | adjusted to 6.0 with aqueous ammonia |
| Fixing solution | |
| Ammonium thiosulfate | 175.0 g |
| Anhydrous sodium sulfite | 8.6 g |
| Sodium metasulfite | 2.3 g |
| Water | to make 1,000 ml |
| pH | adjusted to 6.0 with acetic acid |
| Stabilizing solution | |
| Formaldehyde (37% aq. sol.) | 1.5 ml |
| Konidax (product of Konica Corp.) | 7.5 ml |
| Water | to make 1,000 ml |

The fog, sensitivity and raw stock stability of sample Nos. 101–115 were evaluated by the following procedures and the results are shown in Table 1.

Sensitivity: Expressed as the reciprocal of the amount of exposure necessary to impart fog (min. density) +0.1. The results are indicated in relative values, with the value for sample No. 101 being taken as 100.

Raw stock stability: Samples as prepared by coating emulsion layers were left to stand for 3 days either under natural conditions (run C) or at a temperature of 50° C. and 80% r.h. (run D under accelerated aging conditions). The sensitivity of run D to green light as compared to the sensitivity of run C was expressed in relative values, with the value for run C being taken as 100. The higher the value of D/C, the better the raw stock stability of samples.

TABLE 1

| Sample No. | | Compound | Amount (mol/mol AgX) | Fog | Sensitivity | Raw stock stability |
|---|---|---|---|---|---|---|
| Comparison | 101 | — | — | 0.16 | 100 | 64 |
| | 102 | CR-1 | $7.5 \times 10^{-5}$ | 0.25 | 84 | 65 |
| | 103 | CR-3 | $7.5 \times 10^{-5}$ | 0.22 | 89 | 62 |
| | 104 | CR-4 | $7.5 \times 10^{-5}$ | 0.35 | 41 | 54 |
| Invention | 105 | II-1 | $7.5 \times 10^{-5}$ | 0.12 | 153 | 81 |
| | 106 | II-2 | $7.5 \times 10^{-5}$ | 0.12 | 159 | 84 |
| | 107 | II-5 | $7.5 \times 10^{-5}$ | 0.13 | 149 | 79 |
| | 108 | II-36 | $7.5 \times 10^{-5}$ | 0.12 | 142 | 76 |
| | 109 | II-37 | $7.5 \times 10^{-5}$ | 0.13 | 135 | 75 |
| | 110 | II-38 | $7.5 \times 10^{-5}$ | 0.14 | 139 | 74 |
| | 111 | II-39 | $7.5 \times 10^{-5}$ | 0.13 | 138 | 76 |
| | 112 | II-40 | $7.5 \times 10^{-5}$ | 0.13 | 134 | 75 |
| | 113 | II-65 | $7.5 \times 10^{-5}$ | 0.14 | 134 | 73 |
| | 114 | III-1 | $7.5 \times 10^{-5}$ | 0.15 | 138 | 74 |
| | 115 | III-44 | $7.5 \times 10^{-5}$ | 0.15 | 131 | 73 |

As is clear from Table 1, the samples of the present invention had low fog and were improved in terms of sensitivity and the storage stability of raw stock (i.e. samples just after preparation).

EXAMPLE 2

Preparation of Sample No. 201

A silver iodobromide emulsion having an average grain size of 0.4 μm and an average AgI content of 2 mol % was subjected to optimal gold-plus-sulfur sensitization. Thereafter, the emulsion was spectrally sensitized by addition of a sensitizing dye I-10 in an amount of $5.8 \times 10^{-4}$ moles per mole of silver. Then, the emulsion was stabilized by addition of 4-hydroxy-6-methyl-1,3,3a,7-tetrazaindene and 1-phenyl-5-mercaptotetrazole.

Subsequently, a yellow coupler (Y-1) was dissolved in ethyl acetate and tricresyl phosphate (TCP) and the resulting solution was dispersed in an aqueous solution containing gelatin. Then, customary photographic additives including a spreading agent and a hardener were added to the dispersion, thereby preparing an emulsion coating solution. This coating solution was applied onto a subbed triacetyl cellulose base in the usual manner and dried to prepare a light-sensitive material sample No. 201.

Preparation of Sample Nos. 202–208

Sample Nos. 202–208 were prepared by repeating the procedure of preparing sample No. 201 except that the compounds listed in Table 2 were added to the spectral sensitizer I-10 used in sample No. 201.

Preparation of Sample Nos. 209–212

Sample Nos. 209–212 were prepared by repeating the procedure of preparing sample Nos. 205–208 except that the emulsion used was replaced by a silver iodobromide emulsion having an average grain size of 0.4 μm and a core with 15 mol % AgI (average AgI content, 8 mol %).

Sample Nos. 201–212 were subjected to wedge exposure in the usual manner and subsequently processed as in Example 1.

The fog, sensitivity, and raw stock stability of sample Nos. 201–212 were evaluated as in Example 1. The results are shown in Table 2, in which the sensitivity is expressed in relative values, with the value for sample No. 201 being taken as 100, and both sensitivity and raw stock stability are related to blue light.

TABLE 2

| Sample No. | | Compound | Amount (mol/mol AgX) | Fog | Sensitivity | Raw stock stability |
|---|---|---|---|---|---|---|
| Comparison | 201 | — | — | 0.15 | 100 | 70 |
| | 202 | CR-2 | $5.8 \times 10^{-5}$ | 0.18 | 109 | 68 |
| | 203 | CR-5 | $5.8 \times 10^{-5}$ | 0.42 | 28 | 48 |
| Invention | 204 | II-3 | $5.8 \times 10^{-5}$ | 0.14 | 131 | 79 |
| | 205 | II-35 | $5.8 \times 10^{-5}$ | 0.13 | 140 | 84 |
| | 206 | II-36 | $5.8 \times 10^{-5}$ | 0.13 | 145 | 85 |
| | 207 | II-51 | $5.8 \times 10^{-5}$ | 0.12 | 138 | 80 |
| | 208 | III-20 | $5.8 \times 10^{-5}$ | 0.15 | 137 | 79 |
| | 209 | II-35 | $5.8 \times 10^{-5}$ | 0.14 | 181 | 87 |
| | 210 | II-36 | $5.8 \times 10^{-5}$ | 0.13 | 187 | 88 |
| | 211 | II-51 | $5.8 \times 10^{-5}$ | 0.13 | 180 | 86 |
| | 212 | III-20 | $5.8 \times 10^{-5}$ | 0.14 | 176 | 84 |

As is clear from Table 2, the samples of the present invention had low fog and were improved in terms of sensitivity and raw stock stability. Further, comparing sample Nos. 205–208 with sample Nos. 209–212, one can see that further improvements in sensitivity and raw stock stability could be attained in the present invention by using a core/shell type emulsion.

EXAMPLE 3

Preparation of sample No. 301

A silver iodobromide emulsion having an average grain size of 0.4 μm and a core with a AgI content of 15 mol % (average AgI content, 8 mol %) was subjected to optimal gold-plus-sulfur sensitization. Thereafter, the emulsion was spectrally sensitized to red by adding illustrative sensitizing dyes I-87, I-107 and I-98 in respective amounts of $3.2\times10^{-4}$, $3.2\times10^{-4}$ and $0.4\times10^{-4}$ moles per mole of silver. Then, the emulsion was stabilized by addition of 4-hydroxy-6-methyl-1,3,3a,7-tetrazaindene and 1-phenyl-5-mercaptotetrazole.

Subsequently, a cyan coupler (C-1) was dissolved in ethyl acetate and dinonyl phthalate (DNP) and the solution was dispersed in an aqueous solution containing gelatin. Then, customary photographic additives including a spreading agent and a hardener were added to the dispersion, thereby preparing an emulsion coating solution. This coating solution was applied onto a subbed triacetyl cellulose base in the usual manner and dried to prepare a light-sensitive material sample No. 301.

Preparation of sample Nos. 302–310

Sample Nos. 302–310 were prepared by repeating the procedure of preparing sample No. 301 except that the compounds listed in Table 3 were added to the spectral sensitizer used in sample No. 301.

Sample Nos. 301–310 were subjected to wedge exposure in the usual manner and subsequently processed as in Example 1.

The fog, sensitivity and raw stock stability of sample Nos. 301–310 were evaluated as in Example 1. The results are shown in Table 3, in which the sensitivity is expressed in relative values, with the value for sample No. 301 being taken as 100, and both sensitivity and raw stock stability are related to red light.

TABLE 3

| Sample No. | | Compound | Amount (mol/mol AgX) | Fog | Sensitivity | Raw stock stability |
|---|---|---|---|---|---|---|
| Comparison | 301 | — | — | 0.16 | 100 | 70 |
| | 302 | Cr-1 | $6.8\times10^{-5}$ | 0.19 | 104 | 64 |
| | 303 | CR-3 | $6.8\times10^{-5}$ | 0.21 | 103 | 61 |
| | 304 | CR-3 | $13.6\times10^{-5}$ | 0.35 | 84 | 59 |
| | 305 | CR-4 | $6.8\times10^{-5}$ | 0.25 | 85 | 59 |
| Invention | 306 | II-36 | $6.8\times10^{-5}$ | 0.12 | 138 | 84 |
| | 307 | II-36 | $13.6\times10^{-5}$ | 0.13 | 139 | 82 |
| | 308 | II-40 | $6.8\times10^{-5}$ | 0.14 | 136 | 80 |
| | 309 | II-62 | $6.8\times10^{-5}$ | 0.14 | 134 | 79 |
| | 310 | III-41 | $6.8\times10^{-5}$ | 0.15 | 135 | 76 |

As is clear from Table 3, the samples of the present invention had low fog and were improved in terms of sensitivity and raw stock stability.

EXAMPLE 4

Preparation of Sample No. 401

Multi-layered color photographic element sample No. 401 was prepared by forming the following layers in the order written on a triacetyl cellulose film base.

| | |
|---|---|
| First layer: Anti-halo layer (HC) | |
| Black colloidal silver | 0.15 |
| UV Absorber (UV-1) | 0.20 |
| Colored can coupler (CC-1) | 0.02 |
| High-boiling Point solvent (Oil-1) | 0.20 |
| High-boiling point solvent (Oil-2) | 0.20 |
| Gelatin | 1.6 |
| Second layer: Intermediate layer (IL-1) | |
| Gelatin | 1.3 |
| Third layer: Less red-sensitive emulsion layer (R-L) | |
| Silver iodobromide emulsion (Em-1) | 0.4 |
| Silver iodobromide emulsion (Em-2) | 0.3 |
| Sensitizing dye (I-87) | $3.2\times10^{-4}$(mol/mol Ag) |
| Sensitizing dye (I-107) | $3.2\times10^{-4}$(mol/mol Ag) |
| Sensitizing dye (I-98) | $0.2\times10^{-4}$(mol/mol Ag) |
| Cyan coupler (C-1) | 0.50 |
| Cyan coupler (C-2) | 0.13 |
| Colored cyan coupler (CC-1) | 0.07 |
| DIR compound (D-1) | 0.006 |
| DIR compound (D-2) | 0.01 |
| High-boiling point solvent (Oil-1) | 0.55 |
| Gelatin | 1.0 |
| Fourth layer: Highly red-sensitive emulsion layer (R-H) | |
| Silver iodobromide emulsion (Em-3) | 0.9 |
| Sensitizing dye (I-87) | $1.7\times10^{-4}$(mol/mol Ag) |
| Sensitizing dye (I-107) | $1.6\times10^{-4}$(mol/mol Ag) |
| Sensitizing dye (I-98) | $0.1\times10^{-4}$(mol/mol Ag) |
| Cyan coupler (C-2) | 0.23 |
| Colored cyan coupler (CC-1) | 0.03 |
| DIR compound (D-2) | 0.02 |
| High-boiling point solvent Oil-1 | 0.25 |
| Gelatin | 1.0 |

-continued

| | |
|---|---|
| Fifth layer: Intermediate layer (IL-2) | |
| Gelatin | 0.8 |
| Sixth layer: Less green-sensitive emulsion layer (G-L) | |
| Silver iodobromide emulsion (Em-1) | 0.6 |
| Silver iodobromide emulsion (Em-2) | 0.2 |
| Sensitizing dye (I-39) | $0.7 \times 10^{-4}$(mol/mol Ag) |
| Sensitizing dye (1-60) | $0.8 \times 10^{-4}$(mol/mol Ag) |
| Magenta coupler (M-1) | 0.17 |
| Magenta coupler (M-2) | 0.43 |
| Colored Magenta coupler (CM-1) | 0.10 |
| DIR compound (D-3) | 0.02 |
| High-boiling point solvent (Oil-2) | 0.7 |
| Gelatin | 1.0 |
| Seventh layer: Highly green-sensitive emulsion layer (G-H) | |
| Silver iodobromide emulsion (Em-3) | 0.9 |
| Sensitizing dye (I-50) | $1.1 \times 10^{-4}$(mol/mol Ag) |
| Sensitizing dye (I-35) | $2.0 \times 10^{-4}$(mol/mol Ag) |
| Sensitizing dye (I-40) | $0.3 \times 10^{-4}$(mol/mol Ag) |
| Magenta coupler (M-1) | 0.03 |
| Magenta coupler (M-2) | 0.13 |
| Colored magenta coupler (CM-1) | 0.04 |
| DIR compound (D-3) | 0.004 |
| High-boiling point solvent (Oil-2) | 0.35 |
| Gelatin | 1.0 |
| Eighth layer: Yellow filter layer (YC) | |
| Yellow colloidal silver | 0.1 |
| Additive (SC-1) | 0.12 |
| Additive (HS-1) | 0.07 |
| Additive (HS-2) | 0.07 |
| High-boiling point solvent (Oil-2) | 0.15 |
| Gelatin | 1.0 |
| Ninth layer: Less blue-sensitive emulsion layer (B-L) | |
| Silver iodobromide emulsion (Em-1) | 0.25 |
| Silver iodobromide emulsion (Em-2) | 0.25 |
| Sensitizing dye (I-10) | $5.8 \times 10^{-4}$(mol/mol Ag) |
| Yellow coupler (Y-1) | 0.60 |
| Yellow coupler (Y-2) | 0.32 |
| DIR compound (D-1) | 0.003 |
| DIR compound (D-2) | 0.006 |
| High-boiling point solvent (Oil-2) | 0.18 |
| Gelatin | 1.3 |
| Tenth layer: Highly blue-sensitive emulsion layer (B-H) | |
| Silver iodobromide emulsion (Em-4) | 0.5 |
| Sensitizing dye (I-3) | $3.0 \times 10^{-4}$(mol/mol Ag) |
| Sensitizing dye (I-17) | $1.2 \times 10^{-4}$(mol/mol Ag) |
| Yellow coupler (Y-1) | 0.18 |
| Yellow coupler (Y-2) | 0.10 |
| High-boiling point solvent (Oil-2) | 0.05 |
| Gelatin | 1.0 |
| Eleventh layer: First protective layer (PRO-1) | |
| Silver iodobromide emulsion (Em-5) | 0.3 |
| UV Absorber (UV-1) | 0.07 |
| UV Absorber (UV-2) | 0.1 |
| Additive (HS-1) | 0.2 |
| Additive (HS-2) | 0.1 |
| High-boiling point solvent (Oil-1) | 0.07 |
| High-boiling point solvent (Oil-2) | 0.07 |
| Gelatin | 0.8 |
| Twelfth layer: Second protective layer (PRO-2) | 0.13 |
| Alkali-soluble matting agent (average particle size, 2 μm) | 0.13 |
| polymethyl methacrylate (average particle size, 3 μm) | 0.02 |
| Gelatin | 0.5 |

Besides the compounds mentioned above, a coating aid SU-2, a dispersion aid SU-1, a hardener H-1, a hardener H-2, as well as dyes AI-1 and AI-2 were also added, as appropriate, to the respective layers. All of the emulsions used in sample No. 401 were monodispersed emulsions with a higher AgI content in the interior than in the surface, and they had the following characteristics:

Em-1: average AgI content, 7.5 mol %; octahedral; grain size, 0.55 μm

Em-2: average AgI content, 2.5 mol %; octahedral; grain size, 0.36 μm

Em-3: average AgI content, 8.0 mol %; octahedral; grain size, 0,84 μm

Em-4: average AgI content, 8.5 mol %; octahedral; grain size, 1.02 μm

Em-5: average AgI content, 2.0 mol %; octahedral; grain size, 0.08 μm

Preparation of sample Nos. 402–415

Sample Nos. 402–415 were prepared by repeating the procedure of preparing of preparing sample No. 401 except that the compounds listed in Table 4 were added to the spectral sensitizers contained in the seventh layer.

Sample Nos. 401–415 were subjected to wedge exposure in the usual manner and subsequently processed as in Example 1.

The sensitivity and raw stock stability of sample Nos. 401–415 were evaluated as in Example 1. The results are shown in Table 4, in which the sensitivity is expressed in relative values, with the value for sample No. 401 being taken as 100, and both sensitivity and raw stock stability are related to green light.

| Sample No. | | Compound | Amount (mol/mol AgX) | Sensitivity | Raw stock stability |
|---|---|---|---|---|---|
| Comparison | 401 | — | — | 100 | 58 |
| | 402 | CR-1 | $3.4 \times 10^{-5}$ | 85 | 64 |
| | 403 | CR-3 | $3.4 \times 10^{-5}$ | 86 | 68 |
| | 404 | CR-3 | $6.8 \times 10^{-5}$ | 59 | 69 |

-continued

| Sample No. | | Compound | Amount (mol/mol AgX) | Sensitivity | Raw stock stability |
|---|---|---|---|---|---|
| | 405 | CR-5 | $3.4 \times 10^{-5}$ | 48 | 72 |
| Invention | 406 | II-1 | $3.4 \times 10^{-5}$ | 149 | 78 |
| | 407 | II-2 | $3.4 \times 10^{-5}$ | 152 | 79 |
| | 408 | II-2 | $6.8 \times 10^{-5}$ | 156 | 76 |
| | 409 | II-36 | $3.4 \times 10^{-5}$ | 139 | 75 |
| | 410 | II-36 | $6.8 \times 10^{-5}$ | 141 | 74 |
| | 411 | II-62 | $3.4 \times 10^{-5}$ | 129 | 73 |
| | 412 | III-1 | $3.4 \times 10^{-5}$ | 132 | 74 |
| | 413 | III-2 | $3.4 \times 10^{-5}$ | 135 | 73 |
| | 414 | III-22 | $3.4 \times 10^{-5}$ | 128 | 73 |
| | 415 | III-44 | $3.4 \times 10^{-5}$ | 131 | 74 |

As Table 4 shows, the samples of the present invention were improved in terms of both sensitivity and raw stock stability.

C-1

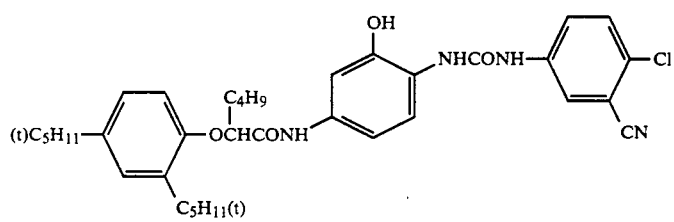

C-2

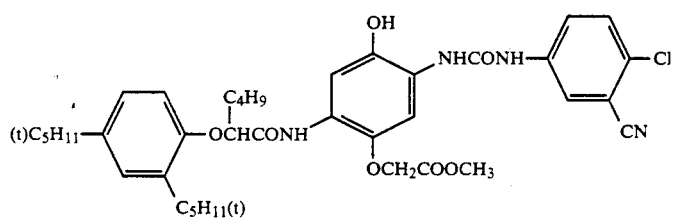

M-1

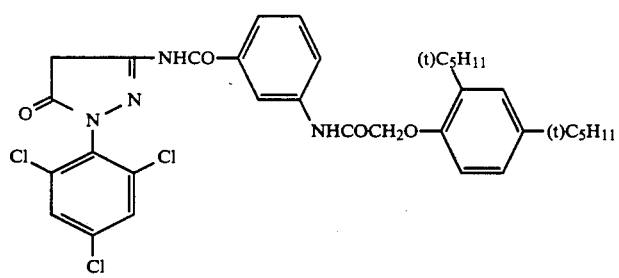

M-2

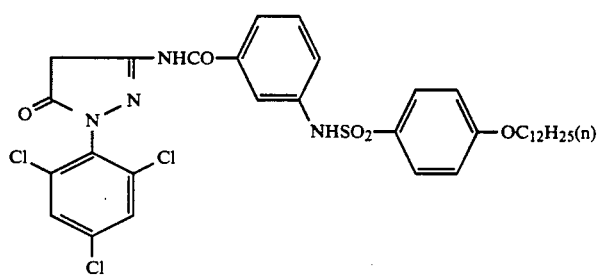

-continued
Y-1
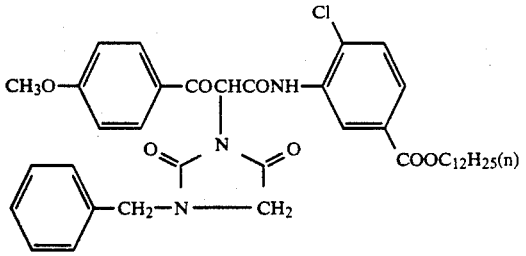
Y-2
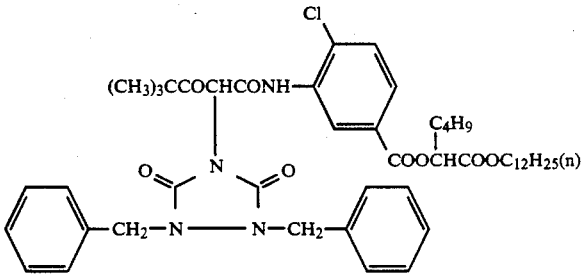
CC-1
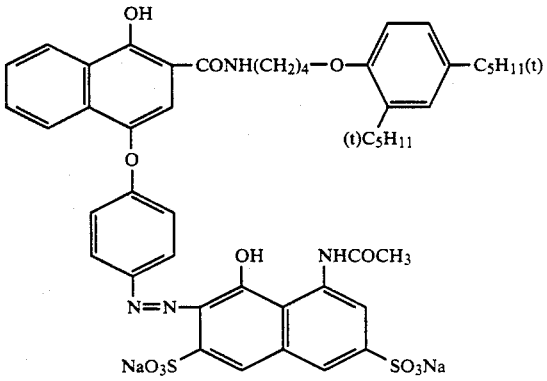
CM-1
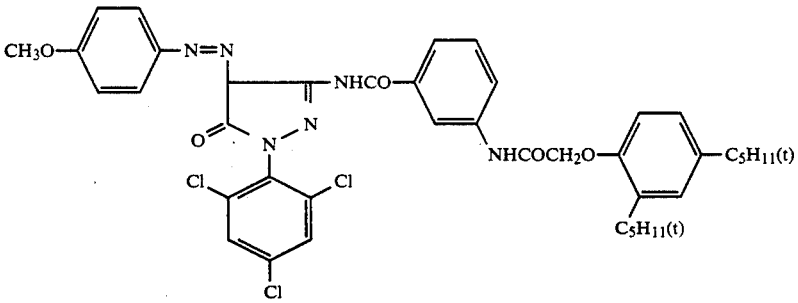
D-1
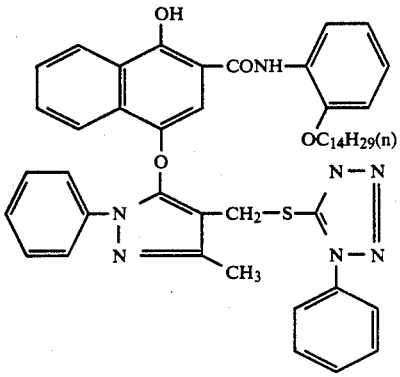

-continued
D-2
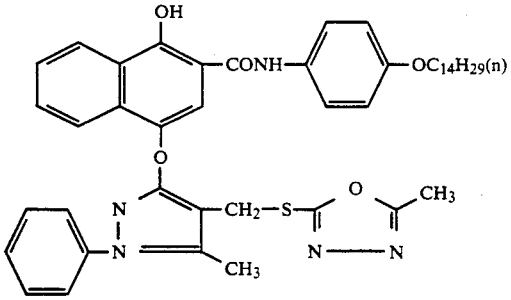
D-3
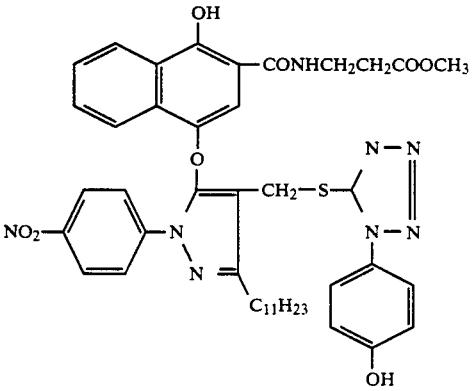
HS-1
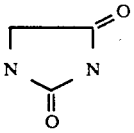
HS-2
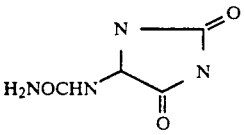
H-1
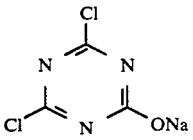
H-2
$[(CH_2{=}CHSO_2CH_2)_3CCH_2SO_2(CH_2)_2]_2N(CH_2)_2SO_3K$
Su-1
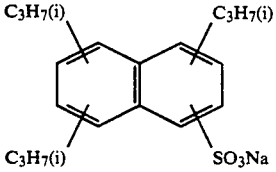
(Alkanol XC)
Su-2
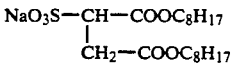
SC-1
2:3 mixture of
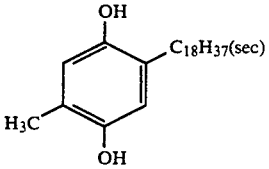
and
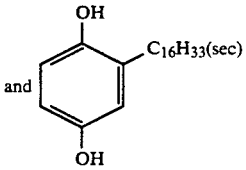

-continued
SC-2
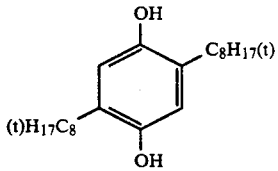
Oil-1
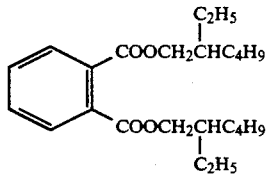
Oil-2
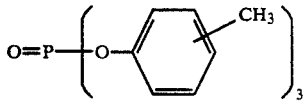
Oil-3
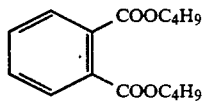
AI-1
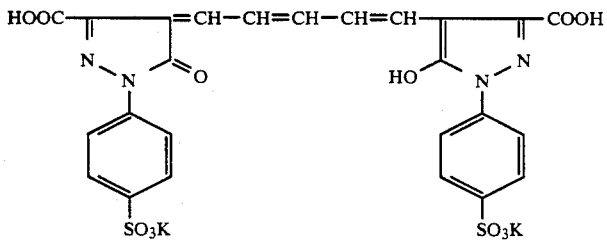
AI-2
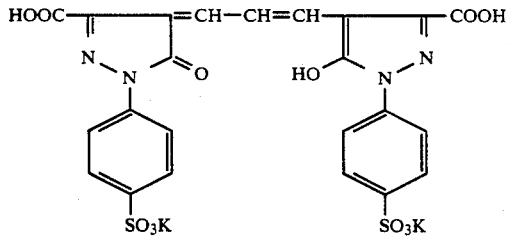
UV-1
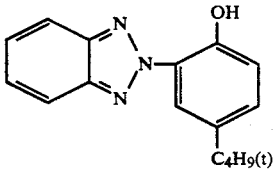
UV-2
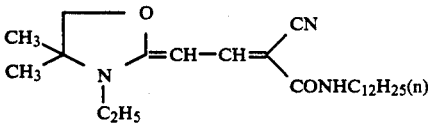
Compounds used in comparisons
CR-1
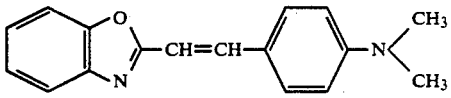

-continued

CR-2

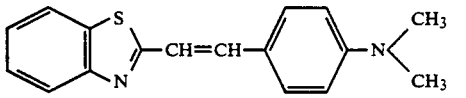

CR-3

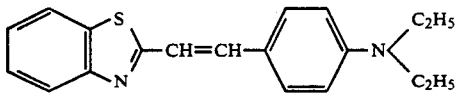

CR-4

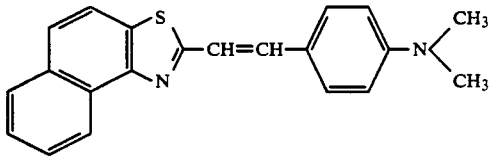

CR-5

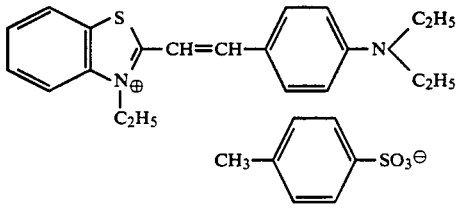

As demonstrated by Examples 1–4, the present invention provides a silver halide photographic material that is low in fog, that has enhanced spectral sensitivity and that can be stored for a prolonged period without deterioration after its preparation (i.e., has good raw stock stability).

What is claimed is:

1. A silver halide photographic material having one or more light-sensitive silver halide emulsion layers on a support, which said photographic material is characterized in that at least one of said light-sensitive emulsion layers contains silver halide grains that are spectrally sensitized with at least one of the spectral sensitizers represented by the following general formula (Ia) or (Ib) and further contains at least one of the compounds represented by the following formula (II)

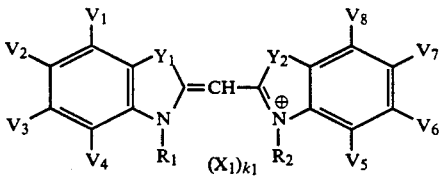

(Ia)

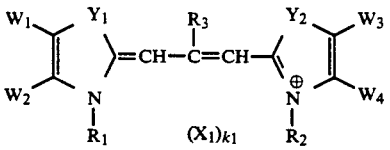

(Ib)

$R_1$ and $R_2$ are each independently a substituted or unsubstituted alkyl group; $X_1$ is a charge balancing counter ion; $K_1$ represents a value of zero or more for neutralizing electric charges;

$Y_1$ and $Y_2$ are each an oxygen atom, a sulfur atom, a selenium atom, a tellurium atom or $$-\overset{|}{N}-R_4;$$

$V_1$–$V_8$ are each a hydrogen atom, an alkyl group, an alkoxyl group, a halogen atom, a phenyl group, a hydroxyl group, a cyano group, an alkoxycarbonyl group, a carbamoyl group, a sulfamoyl group, or a sulfonyl group, provided that $V_1$ and $V_2$, or $V_2$ and $V_3$, or $V_3$ and $V_4$, or $V_5$ and $V_6$, or $V_6$ and $V_7$ or $V_7$ and $V_8$ may combine with each other to form a benzene ring, a cyclohexene ring or a thiophene ring; $R_4$ is a substituted or unsubstituted alkyl or aryl group; $W_1$–$W_4$ are each a hydrogen atom, an alkyl group or a phenyl group, provided that $W_1$ and $W_2$ and/or $W_3$ and $W_4$ may combine with each other to form a benzene ring, a cyclohexene ring, a thiophene ring or a naphthalene group; $R_3$ is a hydrogen atom, an alkyl group, an aralkyl group, an aryl group, a heterocyclic group or an acidic nucleus containing group;

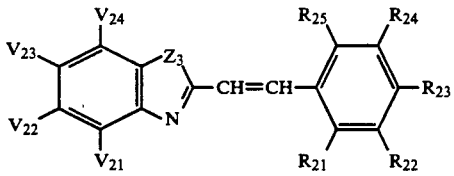

(II)

where $Z_3$ is an oxygen atom, a sulfur atom, a selenium atom, a tellurium atom or $$-\overset{|}{N}-R_{26}$$

group; $V_{21}$, $V_{23}$ and $V_{24}$ are each a hydrogen atom, a halogen atom, an aryl group, a substituted or unsubstituted alkyl group, an alkoxyl group, an alkoxycarbonyl group, a carboxyl group, a hydroxyl group or a cyano group, $V_{22}$ provided that $V_{21}$ and $V_{22}$, or $V_{22}$ and $V_{23}$ or $V_{23}$ and $V_{24}$ may be condensed together to form a benzene ring; $R_{21}$, $R_{22}$, $R_{23}$, $R_{24}$ and $R_{25}$ are each a hydrogen atom, a halogen atom, a hydroxyl group, an alkyl group, an alkoxyl group, an aryl group; and $R_{26}$ is a substituted or unsubstituted alkyl or aryl group.

2. A silver halide photographic material according to claim 1 wherein the spectral sensitizer represented by the general formula (Ia) is added in an amount of $2\times10^{-6}$ to $1\times10^{-2}$ mole per mole of silver halide.

3. A silver halide photographic material according to claim 1 wherein the spectral sensitizer represented by the general formula (Ia) is added in an amount of $5\times10^{-6}$ to $5\times10^{-3}$ moles per mole of silver halide.

4. A silver halide photographic material according to claim 1 wherein the compound represented by the general formula (II) is used in an amount of $1\times10^{-8}$ to $1\times10^{-2}$ mole per mole of silver halide in the emulsion.

5. A silver halide photographic material according to claim 1 wherein the molar ratio of the spectral sensitizer of the general formula (Ia) or (Ib) to the compound of the general formula (II) is within the range of 10:1 to 1:100.

6. A silver halide photographic material according to claim 1 wherein the molar ratio of the spectral sensitizer of the general formula (Ia) or (Ib) to the compound of the general formula (II) is within the range of 2:1 to 1:10.

7. A silver halide photographic material according to claim 1 wherein the spectral sensitizer of the general formula (Ia) or (Ib) is added simultaneously with the compound of the general formula (II).

8. A silver halide photographic material according to claim 1 wherein said silver halide grains have a core/-shell structure.

9. A silver halide photographic material according to claim 8 wherein the shell of said silver halide grains is further coated with another shell having a different silver halide composition to provide a multi-layered shell.

10. A silver halide photographic material according to claim 8 wherein said silver halide grains have a shell with a silver iodide content of 2–40 mol %.

11. A silver halide photographic material according to claim 8 wherein said silver halide grains have a shell with a silver iodide content of 10–40 mol %.

12. A silver halide photographic material according to claim 8 wherein said silver halide grains ahve a shell with a silver iodide content of 15–40 mol %.

13. A silver halide photographic material according to claim 1 wherein said silver halide grains are in the form of a normal crystal, a crystal containing twins or a tabular crystal having an aspect ratio of 5 or more.

14. A silver halide photographic material according to claim 13 wherein said silver halide grains are tabular grains having a size of 0.2–30 μm in terms of the diameter of an equivalent circle.

15. A silver halide photographic material according to claim 13 wherein said silver halide grains are tabular grains having a thickness of no more than 0.5 μm.

16. A silver halide photographic material according to claim 1 wherein the spectral sensitizer represented by the general formula (Ib) is added in the amount of $2\times10^{-6}$ to $1\times10^{-2}$ mole per mole of silver halide.

17. A silver halide photographic material according to claim 1 wherein the spectral sensitizer represented by the general formula (Ib) is added in an amount of $5\times10^{-6}$ to $5\times10^{-3}$ moles per mole of silver halide.

* * * * *